US008698852B2

(12) United States Patent
Umezaki

(10) Patent No.: US 8,698,852 B2
(45) Date of Patent: Apr. 15, 2014

(54) DISPLAY DEVICE AND METHOD FOR DRIVING THE SAME

(75) Inventor: Atsushi Umezaki, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 217 days.

(21) Appl. No.: 13/105,312

(22) Filed: May 11, 2011

(65) Prior Publication Data

US 2011/0285755 A1 Nov. 24, 2011

(30) Foreign Application Priority Data

May 20, 2010 (JP) ..... 2010-116046

(51) Int. Cl.
*G09G 5/10* (2006.01)

(52) U.S. Cl.
USPC ..... 345/690; 345/107; 345/87; 345/104

(58) Field of Classification Search
USPC ..... 345/204, 690, 86, 87, 107
See application file for complete search history.

(56) References Cited

U.S. PATENT DOCUMENTS

| | | | | |
|---|---|---|---|---|
| 5,349,366 | A | 9/1994 | Yamazaki et al. | |
| 6,650,462 | B2 * | 11/2003 | Katase | 359/296 |
| 6,774,884 | B2 | 8/2004 | Shimoda et al. | |
| 7,019,889 | B2 | 3/2006 | Katase | |
| 7,336,249 | B2 | 2/2008 | Hirakata et al. | |
| 7,359,110 | B2 | 4/2008 | Katase | |
| 7,755,599 | B2 | 7/2010 | Miyasaka | |
| 7,773,069 | B2 | 8/2010 | Miyasaka et al. | |
| 7,928,935 | B2 | 4/2011 | Kanda | |
| 8,081,155 | B2 | 12/2011 | Kajino | |
| 8,144,081 | B2 | 3/2012 | Miyazawa | |
| 8,178,926 | B2 | 5/2012 | Nakayama | |
| 8,537,103 | B2 | 9/2013 | Koyama | |
| 2004/0222984 | A1 * | 11/2004 | Hamaguchi | 345/211 |
| 2007/0070032 | A1 * | 3/2007 | Chung et al. | 345/107 |
| 2008/0042968 | A1 * | 2/2008 | Oh | 345/102 |
| 2008/0150887 | A1 * | 6/2008 | Kim et al. | 345/107 |
| 2008/0259015 | A1 | 10/2008 | Nose | |
| 2008/0284764 | A1 | 11/2008 | Sah | |
| 2009/0027326 | A1 | 1/2009 | Yoshihara et al. | |

(Continued)

FOREIGN PATENT DOCUMENTS

| | | |
|---|---|---|
| JP | 2002-116733 | 4/2002 |
| JP | 2002-169190 | 6/2002 |
| JP | 2004-102055 | 4/2004 |
| JP | 2007-206471 | 8/2007 |

*Primary Examiner* — Quan-Zhen Wang
*Assistant Examiner* — Chun-Nan Lin
(74) *Attorney, Agent, or Firm* — Nixon Peabody LLP; Jeffrey L. Costellia

(57) ABSTRACT

A method for driving a display device including pixels each including a display element and a transistor is proposed. The driving method has an image production period and an image retention period. In the image production period, a video signal is input to each pixel and the gray level of the display element in each pixel is controlled in accordance with the video signal so that an image is produced. In the image retention period, a retention signal is input to each pixel and the gray level of the display element in each pixel is held so that the image produced in the image production period is retained. Deterioration of the transistor can be suppressed by making the absolute value of the potential difference between the gate and the second terminal of the transistor smaller in the image retention period than in the image production period.

16 Claims, 12 Drawing Sheets

(56) References Cited

U.S. PATENT DOCUMENTS

| | | | | |
|---|---|---|---|---|
| 2009/0058779 | A1 | 3/2009 | Yoshihara et al. | |
| 2009/0066628 | A1 | 3/2009 | Uehara et al. | |
| 2009/0153757 | A1* | 6/2009 | Nose | 349/35 |
| 2009/0322665 | A1* | 12/2009 | Yoshihara | 345/94 |
| 2010/0156967 | A1 | 6/2010 | Watanuki et al. | |
| 2011/0063339 | A1 | 3/2011 | Umezaki et al. | |
| 2011/0063340 | A1 | 3/2011 | Umezaki et al. | |
| 2011/0090183 | A1 | 4/2011 | Yamazaki et al. | |
| 2011/0090204 | A1 | 4/2011 | Yamazaki et al. | |
| 2011/0090207 | A1 | 4/2011 | Yamazaki et al. | |
| 2011/0102696 | A1 | 5/2011 | Yamazaki et al. | |
| 2011/0115839 | A1 | 5/2011 | Takahashi et al. | |
| 2011/0128461 | A1 | 6/2011 | Koyama et al. | |
| 2011/0134350 | A1 | 6/2011 | Yamazaki et al. | |
| 2011/0141082 | A1* | 6/2011 | Yamazaki | 345/209 |
| 2011/0141086 | A1* | 6/2011 | Huang et al. | 345/211 |
| 2011/0148826 | A1 | 6/2011 | Koyama et al. | |
| 2011/0148846 | A1 | 6/2011 | Arasawa et al. | |
| 2011/0193836 | A1 | 8/2011 | Umezaki | |

* cited by examiner

DISPLAY DEVICE AND METHOD FOR DRIVING THE SAME

BACKGROUND OF THE INVENTION

1. Field of the Invention

The technical field of the invention disclosed herein relates to display devices such as liquid crystal display devices and electrophoretic display devices and methods for driving the display devices.

2. Description of the Related Art

In recent years, display devices such as e-book readers have been actively developed. In particular, a technique by which images are displayed using a display element with memory properties has been actively developed since it greatly contributes to the reduction in power consumption (Patent Document 1).

Patent Document 1 discloses an active-matrix electrophoretic display device. The display device in Patent Document 1 has an image production period and an image retention period. In the image production period, a signal is input to a plurality of pixels and the gray level of a display element is controlled in each of the plurality of pixels so that an image is produced. The timing at which a signal is input to a pixel is controlled by controlling the on/off state of a transistor included in the pixel by input of a signal to a scan line. In the image retention period, a common voltage is input to each of the plurality of pixels to remove an electric field in the display element, so that the image produced in the image production period is maintained. After the common voltage is input to each of the plurality of pixels, the transistor in the pixel remains off until an image is produced again.

REFERENCE

Patent Document 1: Japanese Published Patent Application No. 2004-102055

SUMMARY OF THE INVENTION

In a conventional display device, in the image retention period, a signal that is input to a scan line in order to turn off the transistor in the pixel is the same as that in the image production period. Therefore, a high voltage continues to be applied to the transistor in the image retention period, which results in deterioration of the transistor. Moreover, in the image retention period, a voltage applied to the display element is changed because of the off-state current of the transistor. Thus, an electric field is generated in the display element, so that the gray level of the display element is changed. Accordingly, an image cannot be maintained for a long time.

In view of the above problems, objects of embodiments of the present invention are to reduce a voltage applied to a transistor in an image retention period, to suppress deterioration of a transistor, to reduce the off-state current of a transistor, to increase the time during which an image can be maintained, and to provide a display device that can achieve any of these objects. Note that one embodiment of the present invention achieves at least one of the above objects.

One embodiment of the present invention is a method for driving a display device including a display element sandwiched between a pixel electrode and a common electrode and a transistor having a first terminal electrically connected to a source signal line, a second terminal electrically connected to the pixel electrode, and a gate electrically connected to a gate signal line. The driving method has a first period, a second period, and a third period. The first period includes a period for applying a first potential to the gate signal line to turn on the transistor and inputting a first signal to the pixel electrode through the source signal line, and a period for applying a second ®potential to the gate signal line to turn off the transistor. The second period includes a period for applying the first potential to the gate signal line to turn on the transistor and inputting a second signal to the pixel electrode through the source signal line, and a period for applying the second potential to the gate signal line to turn off the transistor. The third period includes a period for applying a third potential to the gate signal line to turn off the transistor. The absolute value of a potential difference between the third potential and a potential of the second signal is made smaller than the absolute value of a potential difference between the second potential and the potential of the second signal.

One embodiment of the present invention is a method for driving a display device including a display element sandwiched between a pixel electrode and a common electrode and a transistor having a first terminal electrically connected to a source signal line, a second terminal electrically connected to the pixel electrode, and a gate electrically connected to a gate signal line. The driving method has a first period, a second period, and a third period. The first period includes a period for applying a first potential to the gate signal line to turn on the transistor and inputting a first signal to the pixel electrode through the source signal line, and a period for applying a second potential to the gate signal line to turn off the transistor. The second period includes a period for applying the first potential to the gate signal line to turn on the transistor and inputting a second signal to the pixel electrode through the source signal line, and a period for applying the second potential to the gate signal line to turn off the transistor. The third period includes a period for applying a third potential to the gate signal line to turn off the transistor. The third potential is higher than the second potential and lower than the first potential.

In the method for driving a display device, which is one embodiment of the present invention, the first signal may have a fourth potential higher than a potential of the common electrode, a fifth potential lower than the potential of the common electrode, and a sixth potential lower than the fourth potential and higher than the fifth potential.

In the method for driving a display device, which is one embodiment of the present invention, the second signal may have a function of maintaining a gray level of the display element.

In the method for driving a display device, which is one embodiment of the present invention, the transistor may include an oxide semiconductor.

One embodiment of the present invention is a display device that includes a pixel including a display element sandwiched between a pixel electrode and a common electrode and a transistor having a first terminal electrically connected to a source signal line, a second terminal electrically connected to the pixel electrode, and a gate electrically connected to a gate signal line; a gate driver circuit; and a source driver circuit. The gate driver circuit has a function of selectively applying a first potential and a second potential to the gate signal line in a first period and a second period and applying a third potential to the gate signal line in a third period. The source driver circuit has a function of outputting a first signal to the source signal line in the first period and outputting a second signal to the source signal line in the second period. The first potential is a potential for turning off the transistor. The second potential is a potential for turning on the transistor. The third potential is a potential for turning off the transistor. The absolute value of a potential difference between the third potential and a potential of the second signal may be smaller than the absolute value of a potential difference between the second potential and the potential of the second signal.

One embodiment of the present invention is a display device that includes a pixel including a display element sandwiched between a pixel electrode and a common electrode and a transistor having a first terminal electrically connected to a source signal line, a second terminal electrically connected to the pixel electrode, and a gate electrically connected to a gate signal line; a gate driver circuit; and a source driver circuit. The gate driver circuit has a function of selectively applying a first potential and a second potential to the gate signal line in a first period and a second period and applying a third potential to the gate signal line in a third period. The source driver circuit has a function of outputting a first signal to the source signal line in the first period and outputting a second signal to the source signal line in the second period. The first potential is a potential for turning off the transistor. The second potential is a potential for turning on the transistor. The third potential is a potential for turning off the transistor. The third potential is higher than the second potential and lower than the first potential.

In the display device, which is one embodiment of the present invention, the first signal may have a fourth potential higher than a potential of the common electrode, a fifth potential lower than the potential of the common electrode, and a sixth potential lower than the fourth potential and higher than the fifth potential.

In the display device, which is one embodiment of the present invention, the second signal may have a function of maintaining a gray level of the display element.

In the display device, which is one embodiment of the present invention, the transistor may include an oxide semiconductor.

According to one embodiment of the present invention, a voltage applied to a transistor can be reduced in an image retention period; deterioration of a transistor can be suppressed; the off-state current of a transistor can be reduced; and/or the time during which an image can be maintained can be increased.

DETAILED DESCRIPTION OF THE INVENTION

Figure 1:
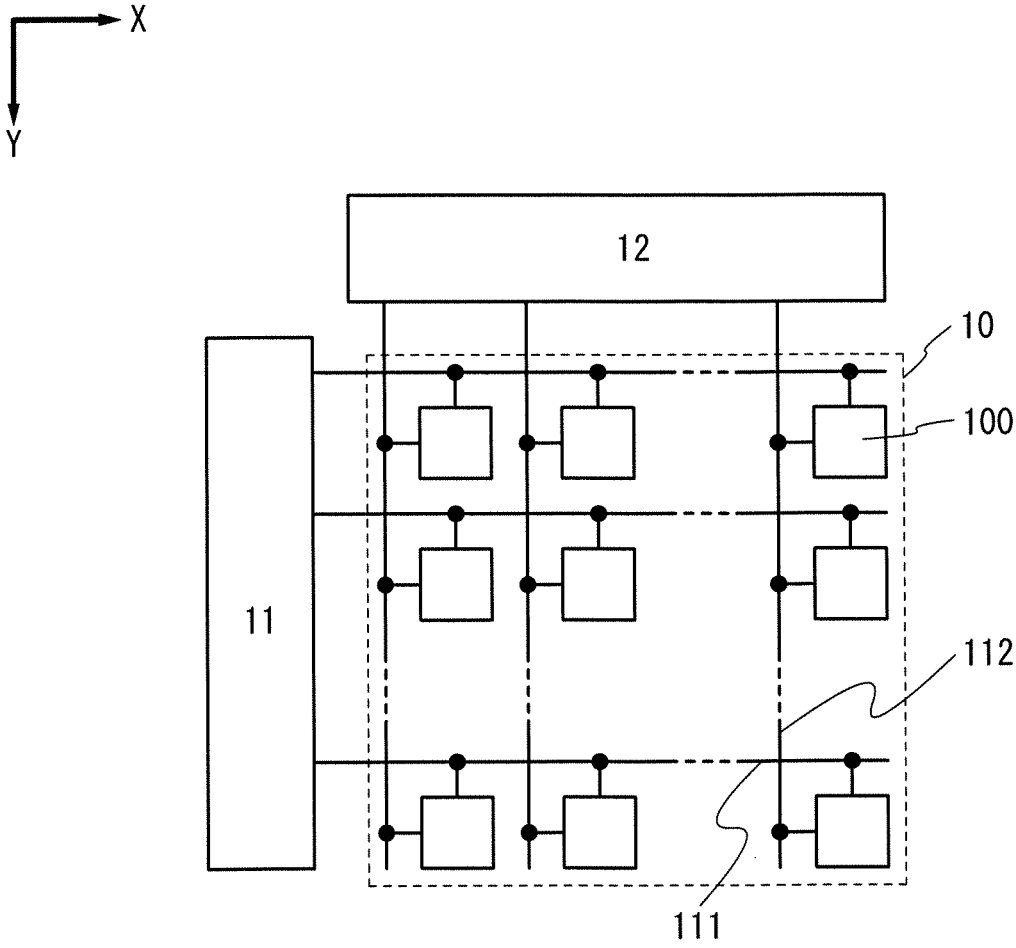
FIG. 1 illustrates a display device according to one embodiment of the present invention.

Embodiments of the present invention will be described below with reference to the accompanying drawings. Note that the present invention is not limited to the description below, and it is easily understood by those skilled in the art that modes and details can be changed in various ways without departing from the spirit and scope of the present invention. Therefore, the present invention should not be construed as being limited to the following description of the embodiments. Note that in structures of the present invention described below, the same portions or portions having similar functions are denoted by common reference numerals in different drawings.

Note that the size, the thickness of a layer, signal waveform, and a region of components illustrated in the drawings and the like in the embodiments are exaggerated for simplicity in some cases. Therefore, embodiments of the present invention are not limited to such scales.

Note that terms "first", "second", "third" to "Nth" (N is a natural number) employed in this specification are used in order to avoid confusion between components, and thus do not limit the number of components.

Embodiment 1

In Embodiment 1, a display device which is one embodiment of the invention disclosed herein and a method for driving the display device will be described.

First, a structural example of a display device in Embodiment 1 will be described with reference to FIG. 1. The display device in FIG. 1 includes a display portion (also referred to as a pixel portion) 10 and driver circuits such as a scan line driver circuit 11 and a signal line driver circuit 12. In the display portion 10, a plurality of pixels 100 are arranged in matrix.

In the display portion 10, n gate signal lines 111 (referred to as gate signal lines 111_1 to 111_*n*, where n is a natural number) are extended in the X direction from the scan line driver circuit 11. Moreover, in the display portion 10, m source signal lines 112 (referred to as source signal lines 112_1 to 112_*m*, where m is a natural number) are extended in the Y direction from the signal line driver circuit 12. The pixel 100 is provided at each of the intersection regions of the n gate signal lines 111 and the m source signal lines 112. In other words, the plurality of pixels 100 are arranged in a matrix of n rows and m columns. The gate signal line 111 is a wiring having a function of transmitting an output signal of the scan line driver circuit 11 (e.g., a gate signal), and is also called a wiring or a signal line. The source signal line 112 is a wiring having a function of transmitting an output signal of the signal line driver circuit 12 (e.g., a video signal), and is also called a wiring or a signal line.

The scan line driver circuit 11 is a circuit having a function of controlling the timing of selecting each row, and is also called a driver circuit or a gate driver circuit. The timing of selecting each row is controlled with a gate signal (also referred to as a scan signal) output from the scan line driver circuit 11 to each of the n gate signal lines 111.

The signal line driver circuit 12 is a circuit having a function of outputting a signal to each of the m source signal lines 112 every time one of the rows is selected, and is also called a driver circuit or a source driver circuit.

Note that a variety of wirings in addition to the gate signal lines 111 and the source signal lines 112 may be provided in the display portion 10 depending on the configuration of the pixel 100. Examples of the wirings that can be provided in the display portion 10 are a capacitor line, a power supply line, a signal line, and a gate signal line different from the gate signal lines 111.

Note that a dummy pixel and a dummy wiring (e.g., a dummy gate signal line or a dummy source signal line) may be provided in the display portion 10. In the case where a dummy pixel and a dummy wiring are provided, they are preferably placed at the periphery of the matrix of the plurality of pixels 100. Thus, display defects can be reduced.

The plurality of pixels 100 and the driver circuit (or part thereof) may be formed over one substrate. In particular, the scan line driver circuit 11 has a lower drive frequency than the signal line driver circuit 12, and is thus easily formed over the substrate where the plurality of pixels 100 are formed. Accordingly, the number of external circuits (circuits formed over a substrate different from the substrate provided with the plurality of pixels 100) can be reduced, so that production costs can be reduced. Moreover, the number of connections between the substrate provided with the plurality of pixels 100 and substrates provided with the external circuits can be reduced, leading to increase in yield and/or improvement in reliability.

Figure 2A:
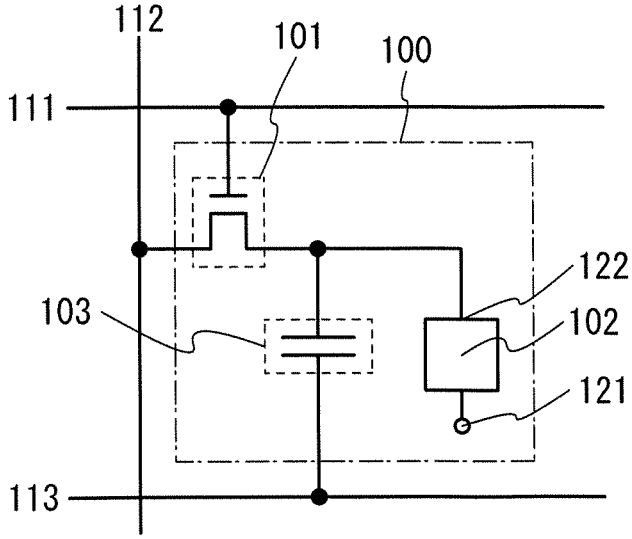
FIGS. 2A and 2B are diagrams each explaining a display device according to one embodiment of the present invention.

Next, an example of a circuit configuration of the pixel 100 included in the display device in Embodiment 1 will be described with reference to FIG. 2A. The pixel 100 illustrated in FIG. 2A includes a transistor 101, a display element 102, and a capacitor 103. The display element 102 is sandwiched between a common electrode 121 and a pixel electrode (also referred to as an electrode) 122. A first terminal (one of a source electrode and a drain electrode) of the transistor 101 is electrically connected to the source signal line 112. A second terminal (the other of the source electrode and the drain electrode) of the transistor 101 is electrically connected to the pixel electrode 122. A gate of the transistor 101 is electrically connected to the gate signal line 111. A first electrode of the capacitor 103 is electrically connected to a capacitor line 113. A second electrode of the capacitor 103 is electrically connected to the pixel electrode 122.

The capacitor line 113 is electrically connected to the first electrodes of the capacitors 103 in all the pixels 100. The capacitor line 113 is a wiring to which a predetermined voltage is supplied, and also referred to as a wiring or a power supply line. It is preferable that the same voltage be supplied to both the capacitor line 113 and the common electrode 121 or that the capacitor line 113 have the same level as the voltage supplied to the common electrode 121. Thus, the kinds of power supply voltages supplied to the display device can be reduced. Note that it is possible that the capacitor line 113 and the common electrode 121 are electrically connected to each other.

The common electrode 121 is an electrode common to the display elements 102 in all the pixels 100, and also referred to as an electrode, a counter electrode, or a cathode. The potential of the common electrode 121 is controlled by supply of a predetermined voltage (also referred to as a common voltage) to the common electrode 121.

Note that the voltage supplied to the common electrode 121 may be varied. Accordingly, the amplitude voltage of a video signal can be reduced, so that power consumption can be reduced. In particular, since a display element with memory properties needs a higher drive voltage than a general display element such as a TN liquid crystal element, a higher voltage is applied to a transistor, which accelerates deterioration of the transistor. Therefore, when the voltage supplied to the common electrode 121 is varied so that the amplitude voltage of a video signal is reduced as described above, the voltage applied to the transistor can be lowered. Thus, deterioration of the transistor can be suppressed.

In the case where the voltage supplied to the common electrode 121 is varied, the voltage applied to the capacitor line 113 may also be varied at the same time. That is, the potential of the common electrode 121 and the potential of the capacitor line 113 may be the same or substantially the same. Accordingly, even when the voltage supplied to the common electrode 121 is changed, the potential of the pixel electrode 122 is also changed at the same time; thus, the voltage applied to the display element 102 can be kept the same. As a result, the gray level of the display element 102 can be maintained.

The transistor 101 is a switch having a function of controlling electrical continuity between the source signal line 112 and the pixel electrode 122, and also referred to as a selection transistor. The transistor 101 may be an n-channel transistor or a p-channel transistor. As the transistor 101, a variety of transistors, for example, a transistor including amorphous silicon, microcrystalline silicon, polycrystalline silicon, or an oxide semiconductor or an organic transistor can be used. Specifically, when a transistor including amorphous silicon, microcrystalline silicon, or an oxide semiconductor is used as the transistor 101, the number of manufacturing steps can be reduced as compared to the case where a transistor including polycrystalline silicon is used. Thus, reduction in production cost, increase in yield, and/or improvement in reliability can be achieved. Moreover, when a transistor including an oxide semiconductor is used as the transistor 101, the off-state current of the transistor 101 can be low; thus, the capacitor 103 can be omitted or reduced in size. Further, when a transistor including an oxide semiconductor is used as the transistor 101, the breakdown voltage of the transistor 101 can be increased. The increase in breakdown voltage of the transistor 101 is highly advantageous particularly when a display element with memory properties, such as an electrophoretic element, is used as the display element 102, because the drive voltage of the display element 102 is high.

The capacitor 103 is a capacitor having a function of keeping the potential of the pixel electrode 122 constant, and also referred to as a storage capacitor. Specifically, the capacitor 103 stores a potential difference between the capacitor line 113 and the pixel electrode 122 or electric charge corresponding to the potential difference. By providing the capacitor 103 in the pixel 100, the potential of the pixel electrode 122 can be kept constant, and the display quality can be improved. Alternatively, the time during which an image can be held can be increased. Further alternatively, the potential of the pixel electrode 122 can be controlled by varying the potential of the capacitor line 113.

Note that the first electrode of the capacitor 103 may be connected to the gate signal line 111 in another row (e.g., the previous row). Thus, the capacitor line 113 can be omitted, and the aperture ratio can be increased.

Note that the capacitor 103 and the capacitor line 113 can be omitted as long as the potential of the pixel electrode 122 can be kept constant. As a result, the aperture ratio can be increased.

The display element 102 is a display element with memory properties. Examples of the display element 102 are a display element using microcapsule electrophoresis (an electrophoretic element or a microcapsule electrophoretic element), a display element using microcup electrophoresis (an electrophoretic element or a microcup electrophoretic element), a display element using horizontal electrophoresis, a display element using vertical electrophoresis, a display element using twisting ball, a display element using liquid powder, a display element using electronic liquid powder, a cholesteric liquid crystal element, chiral nematic liquid crystal, antiferroelectric liquid crystal, polymer dispersed liquid crystal, charged toner, a display element using electrowetting, a display element using electrochromism, and a display element using electrodeposition.

Figure 2B:
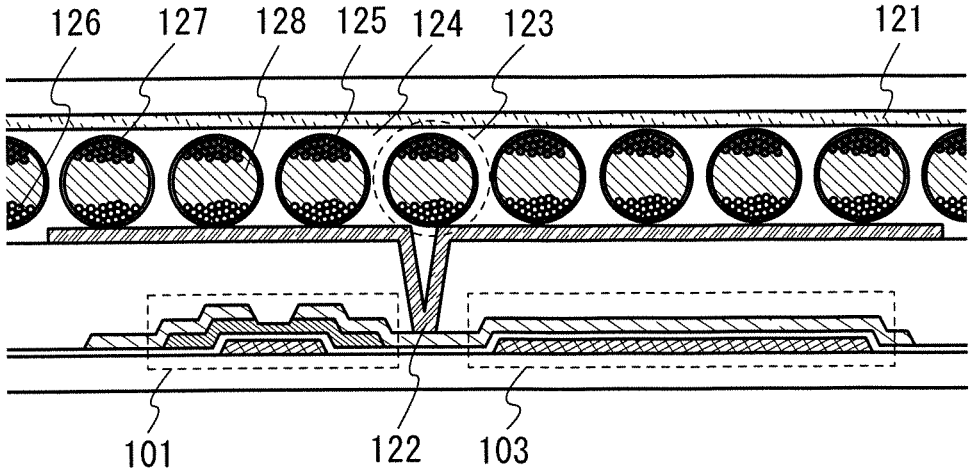

Next, an example of a cross-sectional structure of the pixel 100 when a microcapsule electrophoretic element is used as the display element 102 will be described with reference to FIG. 2B. In the display element 102, a plurality of microcapsules 123 are placed between the common electrode 121 and the pixel electrode 122. The plurality of microcapsules 123 are fixed by a resin 124. The resin 124 serves as a binder and has light-transmitting properties. Note that a space surrounded by the common electrode 121, the pixel electrode 122, and the plurality of microcapsules 123 may be filled with a gas such as air or an inert gas. In such a case, a layer including a glue, an adhesive, or the like is preferably formed on one or both of the common electrode 121 and the pixel electrode 122 to fix the plurality of microcapsules 123.

Each of the plurality of microcapsules 123 includes a film 125, white particles 126 charged either positively or negatively, black particles 127 charged oppositely to the white particles 126, and a light-transmitting dispersant 128. The white particles 126, the black particles 127, and the dispersant 128 are enclosed in the film 125. For color display, the particles enclosed in the film 125 may be colored in blue, green, red, or the like. Alternatively, the dispersant 128 may be colored in blue, green, red, or the like to realize color display. Further alternatively, both the particles enclosed in the film 125 and the dispersant 128 may be colored in blue, green, red, or the like to realize color display. Note that one kind of particles or three or more kinds of particles may be enclosed in the film 125.

In the above display element 102, the white particles 126 and the black particles 127 move when a potential difference is generated between the common electrode 121 and the pixel electrode 122. The gray level of the display element 102 is controlled by using the movement of the particles. For example, as seen from the common electrode 121 side, the gray level of the display element 102 becomes high (e.g., white) when the white particles 126 move to the vicinity of the common electrode 121. On the other hand, the gray level of the display element 102 becomes low (e.g., black) when the black particles 127 move to the vicinity of the common electrode 121.

In addition, when the common electrode 121 and the pixel electrode 122 have the same potential or substantially the same potential or when the absolute value of the potential difference between the common electrode 121 and the pixel electrode 122 is smaller than the absolute value of the threshold voltage of the display element 102, the white particles 126 and the black particles 127 stop moving. By using their properties, the gray level of the display element 102 can be maintained. For example, as seen from the common electrode 121 side, the gray level of the display element 102 can be kept high when the movement of the white particles 126 and the black particles 127 is stopped in a state where the white particles 126 gather around the common electrode 121. On the other hand, the gray level of the display element 102 can be kept low when the movement of the white particles 126 and the black particles 127 is stopped in a state where the black particles 127 gather around the common electrode 121.

Figure 3:
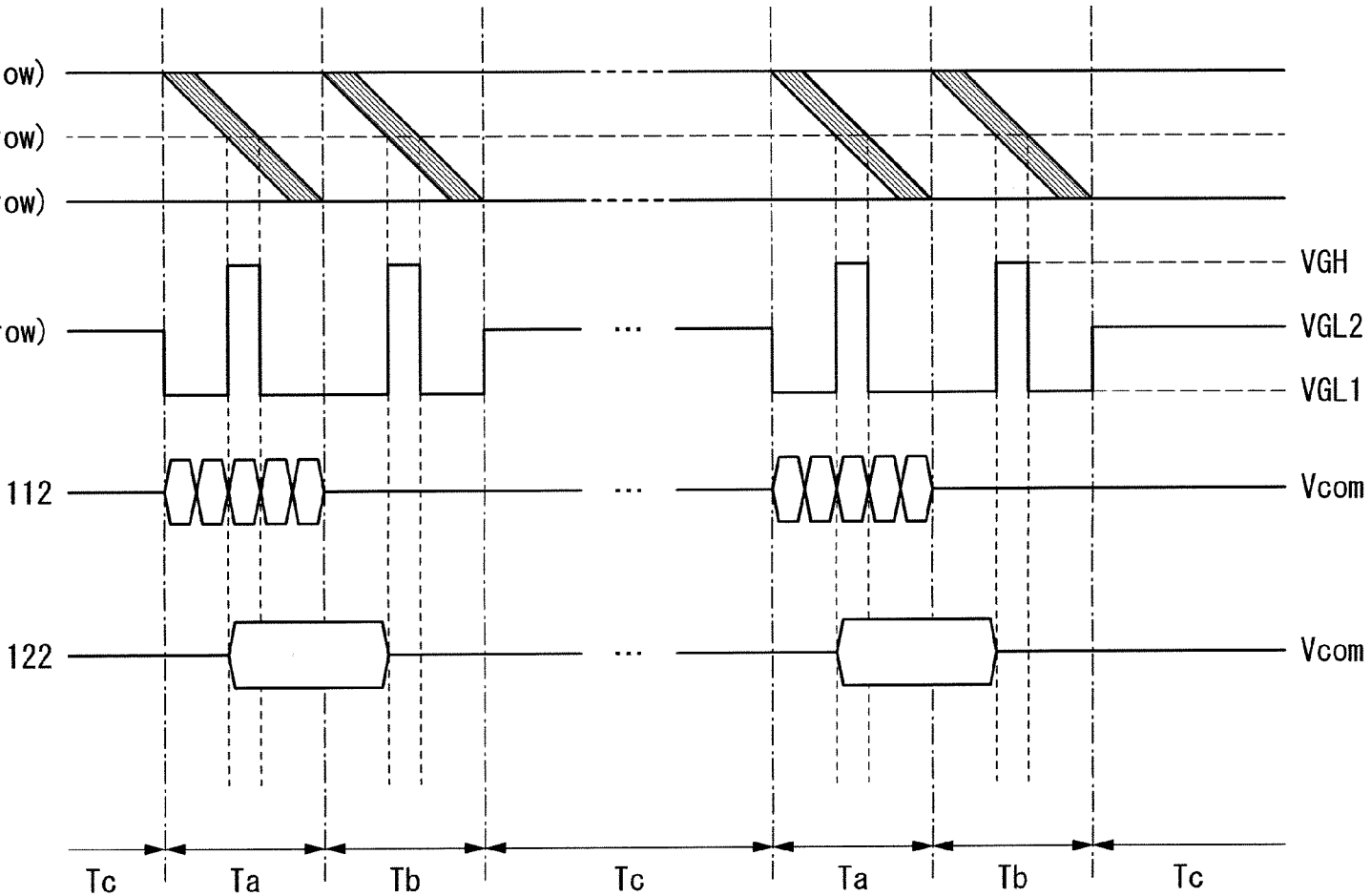
FIG. 3 is a chart for explaining a display device according to one embodiment of the present invention.

Next, a method for driving the display device in Embodiment 1 will be described with reference to FIG. 3. FIG. 3 is an example of a timing chart for the display device in Embodiment 1. The display device in Embodiment 1 can be explained with three divided periods of a period Ta, a period Tb, and a period Tc.

For explanatory convenience, it is assumed in FIG. 3 that the transistor 101 is an n-channel transistor and the potential of the common electrode 121 (referred to as Vcom) is constant.

The period Ta is a period during which an image is displayed or produced (also described as rewritten or updated) on the display portion 10. An image is displayed or produced in such a manner that a video signal (also referred to as a first signal) corresponding to image data is input to each of the plurality of pixels 100 and the gray level of the display element 102 is controlled.

In the period Ta, the scan line driver circuit 11 sequentially selects the first row to the n-th row on a per row basis. In the period Ta, the scan line driver circuit 11 sets the potential of the gate signal line 111 in a row to be selected at a potential VGH (also referred to as a first potential) by applying the potential VGH to the gate signal line 111 in the row to be selected. Moreover, the scan line driver circuit 11 sets the potential of the gate signal line 111 in a row that is not selected at a potential VGL1 (also referred to as a second potential) by applying the potential VGL1 to the gate signal line 111 in the row that is not selected. The potential VGH is higher than the maximum level of a video signal, and the potential VGL1 is lower than the minimum level of the video signal. Accordingly, in each of the pixels 100 in the selected row, the transistor 101 is turned on, and electrical continuity is established between the source signal line 112 and the pixel electrode 122. Furthermore, in each of the pixels 100 in the non-selected row, the transistor 101 is turned off, and electrical continuity between the source signal line 112 and the pixel electrode 122 is broken. Then, the signal line driver circuit 12 outputs a video signal to each of the m source signal lines 112. Thus, video signals are input through the source signal lines 112 to the pixels 100 in the selected row. Moreover, a voltage corresponding to the video signal is held at the capacitor 103, and a voltage corresponding to the video signal is applied to the display element 102. As a result, the gray level of the display element 102 is changed in accordance with the video signal. In the above manner, a video signal can be input to the plurality of pixels 100 by selecting the first to n-th rows. Further, in each of the plurality of pixels 100, the gray level of the display element 102 can be controlled in accordance with the video signal. Thus, an image corresponding to the video signals can be displayed or produced on the display portion 10.

The period Tb is a period during which the image displayed or produced on the display portion 10 in the period Ta is maintained. The image is held in the following manner: a retention signal (also referred to as a second signal) is input to each of the plurality of pixels 100 and the gray level of the display element 102 is maintained. The retention signal is a signal for maintaining the gray level of the display element 102. Accordingly, for example, when a voltage corresponding to a retention signal is applied to the display element 102, the movement of the particles is stopped in the display element 102 and the gray level of the display element 102 is maintained. The retention signal has a fixed potential which is the same or substantially the same as the potential of the common electrode 121.

In the period Tb, the scan line driver circuit 11 sequentially selects the first row to the n-th row on a per row basis. In the period Tb, the scan line driver circuit 11 applies the potential VGH to the gate signal line 111 in the selected row and applies the potential VGL1 to the gate signal line 111 in the non-selected row. Accordingly, in each of the pixels 100 in the selected row, the transistor 101 is turned on, and electrical continuity is established between the source signal line 112 and the pixel electrode 122. Furthermore, in each of the pixels 100 in the non-selected row, the transistor 101 is turned off, and electrical continuity between the source signal line 112 and the pixel electrode 122 is broken. Then, the signal line driver circuit 12 outputs a retention signal to each of the m source signal lines 112. Thus, retention signals are input through the source signal lines 112 to the pixels 100 in the selected row. Moreover, a voltage corresponding to the retention signal is held at the capacitor 103, and a voltage corresponding to the retention signal is applied to the display element 102. As a result, the gray level of the display element 102 is kept at the gray level which is set in the period Ta, or alternatively, the change in gray level of the display element 102 stops. In the above manner, a retention signal can be input to the plurality of pixels 100 by selecting the first to n-th rows. Further, the gray level of the display element 102 can be maintained in each of the plurality of pixels 100. Thus, the image displayed or produced on the display portion 10 in the period Ta can be maintained.

The period Tc is a period during which the image displayed or produced on the display portion 10 in the period Ta is maintained, as in the period Tb. Note that in the period Tc, a signal is not input to the plurality of pixels 100 because the retention signal input to each of the plurality of pixels 100 in the period Tb is maintained. In other words, in the period Tc, the scan line driver circuit 11 makes the first to n-th rows in a non-selection state and does not select a row. Moreover, in the period Tc, a voltage applied to the transistor 101 is lowered in each of the plurality of pixels 100 so that deterioration of the transistor 101 is suppressed.

In the period Tc, the scan line driver circuit 11 makes the first to n-th rows in a non-selection state. In the period Tc, the scan line driver circuit 11 applies a potential VGL2 (also referred to as a third potential) to the gate signal lines 111 in the first to n-th rows. The potential VGL2 is equal to or substantially equal to the potential of the retention signal. Furthermore, in the period Tc, the retention signal is held in the plurality of pixels 100. Accordingly, in each of the plurality of pixels 100, the transistor 101 is turned off, and electrical continuity between the source signal line 112 and the pixel electrode 122 is broken. Therefore, a signal is not input to the plurality of pixels 100, and each of the plurality of pixels 100 continues to hold the retention signal which is input in the period Tb. As a result, the gray level of the display element 102 is kept at the gray level maintained in the period Tb. Thus, the image held in the period Tb, that is, the image displayed or produced on the display portion 10 in the period Ta can be maintained. Moreover, the absolute value of the potential difference between the gate and the second terminal of the transistor 101 is smaller than that in the case where the potential VGL1 is applied to the gate signal line 111. Consequently, deterioration of the transistor 101 can be suppressed.

Here, attention is focused on an i-th row (i is one of 1 to n) to describe the method for driving the display device in Embodiment 1 in detail.

In the period Ta, the scan line driver circuit 11 applies the potential VGH to the gate signal line 111 in the i-th row (the i-th gate signal line 111) and selects the i-th row. Accordingly, in each of the pixels 100 in the i-th row, the transistor 101 is turned on, and electrical continuity is established between the source signal line 112 and the pixel electrode 122. At this time, the signal line driver circuit 12 outputs a video signal corresponding to the pixels 100 in the i-th row to each of the m source signal lines 112. Thus, video signals are input through the source signal lines 112 to the pixels 100 in the i-th row. Moreover, a voltage corresponding to the video signal is held at the capacitor 103, and a voltage corresponding to the video signal is applied to the display element 102. As a result, the gray level of the display element 102 is changed in accordance with the video signal. After that, the scan line driver circuit 11 applies the potential VGL1 to the gate signal line 111 in the i-th row and finishes selection of the i-th row. Accordingly, in each of the pixels 100 in the i-th row, the transistor 101 is turned off, and electrical continuity between the source signal line 112 and the pixel electrode 122 is broken. Note that the video signal is held in each of the pixels 100 in the i-th row. Therefore, a voltage corresponding to the video signal continues to be applied to the display element 102 in each of the pixels 100 in the i-th row until the i-th row is selected again, that is, until the i-th row is selected in the period Tb.

In the period Tb, the scan line driver circuit 11 applies the potential VGH to the gate signal line 111 in the i-th row and selects the i-th row. Accordingly, in each of the pixels 100 in the i-th row, the transistor 101 is turned on, and electrical continuity is established between the source signal line 112 and the pixel electrode 122. At this time, the signal line driver circuit 12 outputs a retention signal to each of the m source signal lines 112. Thus, retention signals are input through the source signal lines 112 to the pixels 100 in the i-th row. Moreover, a voltage corresponding to the retention signal is held at the capacitor 103, and a voltage corresponding to the retention signal is applied to the display element 102. As a result, the gray level of the display element 102 is kept at the gray level which is set in the period Ta, or alternatively, the change in gray level of the display element 102 stops. After that, the scan line driver circuit 11 applies the potential VGL1 to the gate signal line 111 in the i-th row and finishes selection of the i-th row. Accordingly, in each of the pixels 100 in the i-th row, the transistor 101 is turned off, and electrical continuity between the source signal line 112 and the pixel electrode 122 is broken. Note that the retention signal is held in each of the pixels 100 in the i-th row. Therefore, a voltage corresponding to the retention signal continues to be applied to the display element 102 in the pixels 100 in the i-th row until the i-th row is selected again. That is, the gray level of the display element 102 continues to be held.

In the period Tc, the scan line driver circuit 11 applies the potential VGL2 to the gate signal line 111 in the i-th row and keeps the i-th row in a non-selection state. Accordingly, in each of the pixels 100 in the i-th row, the transistor 101 is off, and electrical continuity between the source signal line 112 and the pixel electrode 122 is not established. Note that the retention signal input in the period Tb is held in the pixels 100 in the i-th row. Therefore, in each of the pixels 100 in the i-th row, the gray level of the display element 102 is kept at the gray level maintained in the period Tb. In addition, the absolute value of the potential difference between the gate and the second terminal of the transistor 101 is smaller than that in the case where the potential VGL1 is applied to the gate signal line 111. Consequently, deterioration of the transistor 101 can be suppressed.

As described above, the display device in Embodiment 1 can continue to hold the image displayed or produced in the period Ta.

In the display device in Embodiment 1, the absolute value of the potential difference between the gate and the second terminal of the transistor 101 can be small in the period Tc. Thus, deterioration of the transistor 101, such as shift of the threshold voltage and change in mobility, can be suppressed. The period Tc is a time for maintaining an image and ranges from several seconds to several hours, sometimes from several seconds to several days. Therefore, when a high voltage continues to be applied between the gate and the second terminal of the transistor 101 in the period Tc, the transistor 101 deteriorates severely. For that reason, a small absolute value of the potential difference between the gate and the second terminal of the transistor 101 in the period Tc in the display device of Embodiment 1 is preferable in order to suppress deterioration of the transistor 101.

In the timing chart illustrated in FIG. 3, the scan line driver circuit 11 selectively outputs the potential VGH and the potential VGL1 in the period Ta and the period Tb, and outputs the potential VGL2 in the period Tc. That is, there is no period during which the scan line driver circuit 11 selectively outputs three potentials (VGH, VGL1, and VGL2). For that reason, a digital circuit can be used as the scan line driver circuit 11. Thus, the configuration of the scan line driver circuit 11 can be simplified. Alternatively, the number of transistors included in the scan line driver circuit 11 can be reduced, and the layout area can be reduced.

Here, in order to explain advantages of the display device in Embodiment 1, a driving method of a general display device for maintaining an image is briefly described as a comparative example. In the comparative display device, a display element without memory properties or a display element with extremely low memory properties is used as a display element. Therefore, in order to maintain an image, it is necessary to keep applying an electric field or supplying a current to the display element so as to hold the gray level of the display element. Thus, in a period for maintaining an image, the potential of a pixel electrode varies between pixels.

In contrast to the comparative display device, in the display device in Embodiment 1, the potential of the pixel electrode 122 is set at a predetermined potential (a potential corresponding to a retention signal) in each pixel so that an image is maintained. That is, the potentials of the pixel electrodes 122 in the plurality of pixels 100 are the same or substantially the same. For that reason, the scan line driver circuit 11 can supply the gate signal line 111 with a potential with which the potential difference between the gate and the second terminal of the transistor 101 is reduced. Moreover, in each pixel, the potential difference between the gate and the second terminal of the transistor 101 can be set so that the off-state current of the transistor 101 can be minimized. As a result, the time during which an image can be held can be increased.

In the display device in Embodiment 1, deterioration of the transistor 101 in the pixel 100 can be suppressed. For that reason, amorphous silicon, microcrystalline silicon, or an oxide semiconductor is preferably used for the transistor included in the display device in Embodiment 1. By forming the transistor using such a material, reduction in the number of manufacturing steps, reduction in production cost, increase in yield, and/or increase in size of the display device can be achieved.

In the case where the transistor 101 is a p-channel transistor, it is preferable that the potential VGH be lower than the minimum level of a video signal and the potential VGL1 be higher than the maximum level of the video signal. Accordingly, the transistor 101 is turned on in a selection period and turned off in a non-selection period.

Note that the potential of the retention signal is not limited to a potential that is the same or substantially the same as the potential of the common electrode 121. The potential of the retention signal should be a potential with which the gray level of the display element 102 can be maintained. Therefore, the potential of the retention signal can be any potential as long as the absolute value of the potential difference between the retention signal and the common electrode 121 is smaller than or equal to the absolute value of the threshold voltage (Vth102) of the display element 102. That is, the potential of the retention signal can be in the range of a potential (Vcom−|Vth102|) to a potential (Vcom+|Vth102|).

Note that the potential VGL2 is not limited to a potential that is the same or substantially the same as the potential of the retention signal. The potential VGL2 can be any potential that is higher than the potential VGL1 and lower than the potential VGH. In such a case also, in the period Tc, the absolute value of the potential difference between the gate and the second terminal of the transistor 101 can be smaller than that in the case where the scan line driver circuit 11 applies the potential VGL1 to each of the n gate signal lines 111; thus, deterioration of the transistor 101 can be suppressed.

Note that when the transistor 101 is turned off, the potential of the pixel electrode 122 is sometimes lowered from the potential of the retention signal because of effects by feedthrough, charge injection, or the like. Therefore, the potential VGL2 may be lower than the potential of the retention signal in order that the potential difference between the gate and the second terminal of the transistor 101 is made closer to 0 [V].

Note that the scan line driver circuit 11 may select the first to n-th rows in given order. In that case, the scan line driver circuit 11 preferably includes a decoder circuit. Moreover, the scan line driver circuit 11 may select two or more rows (e.g., two rows or three rows) at the same time, in which case power consumption can be reduced because the number of times the pixels 100 are selected can be reduced. Further, the scan line driver circuit 11 may select only some of the first to n-th rows (i.e., partial driving), in which case power consumption can be reduced because of reduction in the number of rows that the scan line driver circuit 11 selects.

Note that the signal line driver circuit 12 may concurrently output a signal to each of the m source signal lines 112. Thus, a period for inputting a signal to the pixel 100 can be increased, so that the potential of the pixel electrode 122 can be controlled precisely or minutely. Alternatively, one gate selection period can be shortened, so that the frame frequency can be increased. Moreover, the number of pixels 100 arranged in the display portion 10 can be increased. Further alternatively, the load of the source signal line 112 can be increased, so that the display portion 10 can be increased in size. The signal line driver circuit 12 may output a signal to the m source signal lines 112 on a per column basis or every plural columns. In that case, the signal line driver circuit 12 preferably includes a demultiplexer circuit. Accordingly, the number of connections between the substrate provided with the display portion 10 and substrates provided with the external circuits can be reduced, leading to increase in yield, reduction in cost, and/or improvement in reliability. Alternatively, the signal line driver circuit 12 may output a video signal to the m source signal lines 112 on a per column basis or every plural columns and output a retention signal to the m source signal lines 112 at the same time.

Here, driving methods in Embodiment 1, which are different from the above driving method, will be described.

Figure 4:
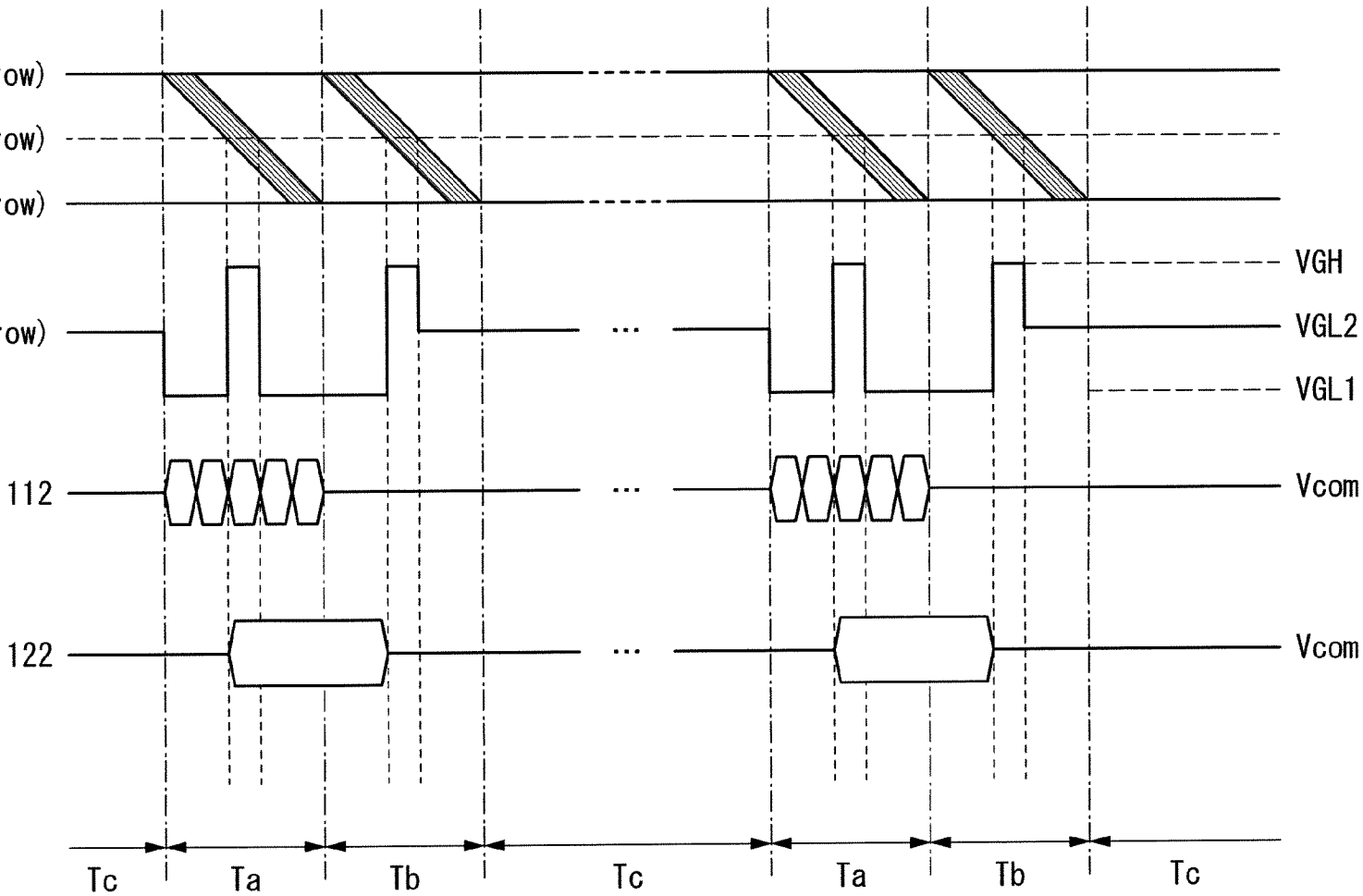
FIG. 4 is a chart for explaining a display device according to one embodiment of the present invention.

In the period Tb, the scan line driver circuit 11 may apply the potential VGL2 to the gate signal line 111 in a row after selection (see FIG. 4). That is, the scan line driver circuit 11 may sequentially apply the potential VGL1, the potential VGH, and the potential VGL2 to the gate signal line 111 in the period Tb. Accordingly, variation in voltage applied to the display element 102 due to variation in potential of the gate signal line 111 can be prevented when the operation in the period Tb ends and the operation in the period Tc starts. As a result, the image retention time can be increased or the display quality can be improved.

Figure 5:
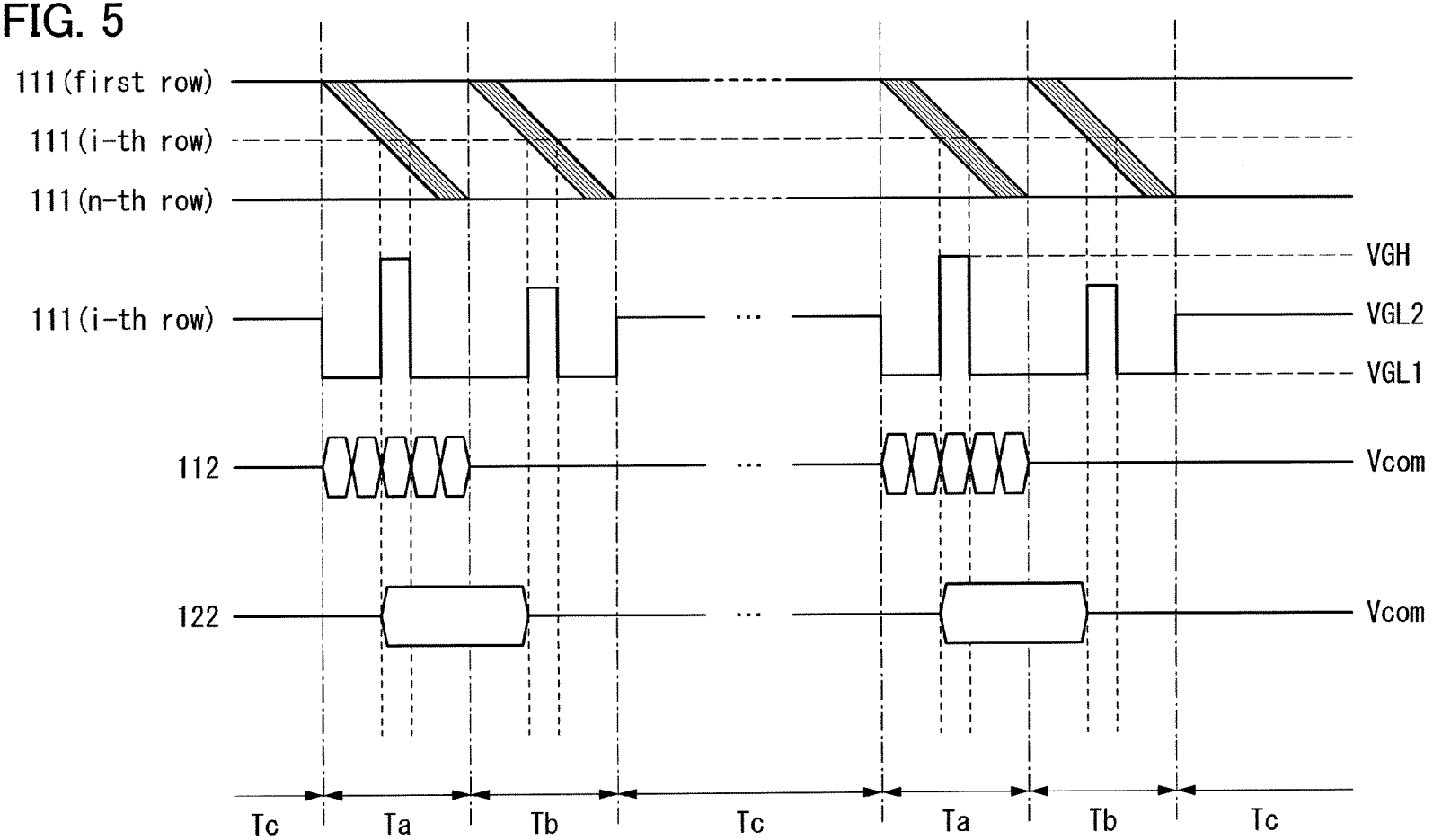
FIG. 5 is a chart for explaining a display device according to one embodiment of the present invention.

In the period Tb, the scan line driver circuit 11 may apply a potential lower than the potential VGH to the gate signal line 111 in a row to be selected (see FIG. 5). Specifically, the potential is higher than the potential VGL2 and lower than the potential VGH; alternatively, the potential is higher than the potential of the retention signal and lower than the potential VGH. In the period Tb, the signal line driver circuit 12 outputs a retention signal to each of the m source signal lines 112. Therefore, the transistor 101 is turned on even when the scan line driver circuit 11 supplies the gate signal line 111 with the potential which is higher than the potential VGL2 and lower than the potential VGH. Accordingly, the amplitude voltage of a gate signal can be reduced in the period Tb, so that power consumption can be reduced.

In the period Tc, the scan line driver circuit 11 may stop outputting a potential or voltage after applying the potential VGL2 to the n gate signal lines 111. In other words, the n gate signal lines 111 may be brought into a floating state. In that case, it is preferable that supply of voltage to the scan line driver circuit 11 be interrupted or that all the switches electrically connected to the n gate signal lines 111 be turned off in the scan line driver circuit 11. Thus, power consumption can be reduced.

In the period Tc, the signal line driver circuit 12 may output a retention signal or a common potential to each of the m source signal lines 112. Accordingly, the source signal line 112 and the pixel electrode 122 have the same potential, so that variation in potential of the pixel electrode 122 can be prevented. As a result, a time during which the gray level of the display element 102 can be maintained can be increased.

In addition, it is possible that the signal line driver circuit 12 does not output a signal to the m source signal lines 112 in the period Tc. In other words, the m source signal lines 112 may be brought into a floating state. In that case, it is preferable that supply of voltage to the signal line driver circuit 12 be interrupted or that all the switches electrically connected to the m source signal lines 112 be turned off in the signal line driver circuit 12. Thus, power consumption can be reduced.

In one gate selection period in the period Ta, the signal line driver circuit 12 may output a video signal to the m source signal lines 112 at the same time or sequentially on a per column basis or every plural columns after outputting an initialization signal (e.g., a potential same as a retention signal or the common electrode 121) to the m source signal lines 112. Thus, continuous application of the same voltage to the display element 102 can be prevented, so that afterimages can be reduced.

Figure 6:
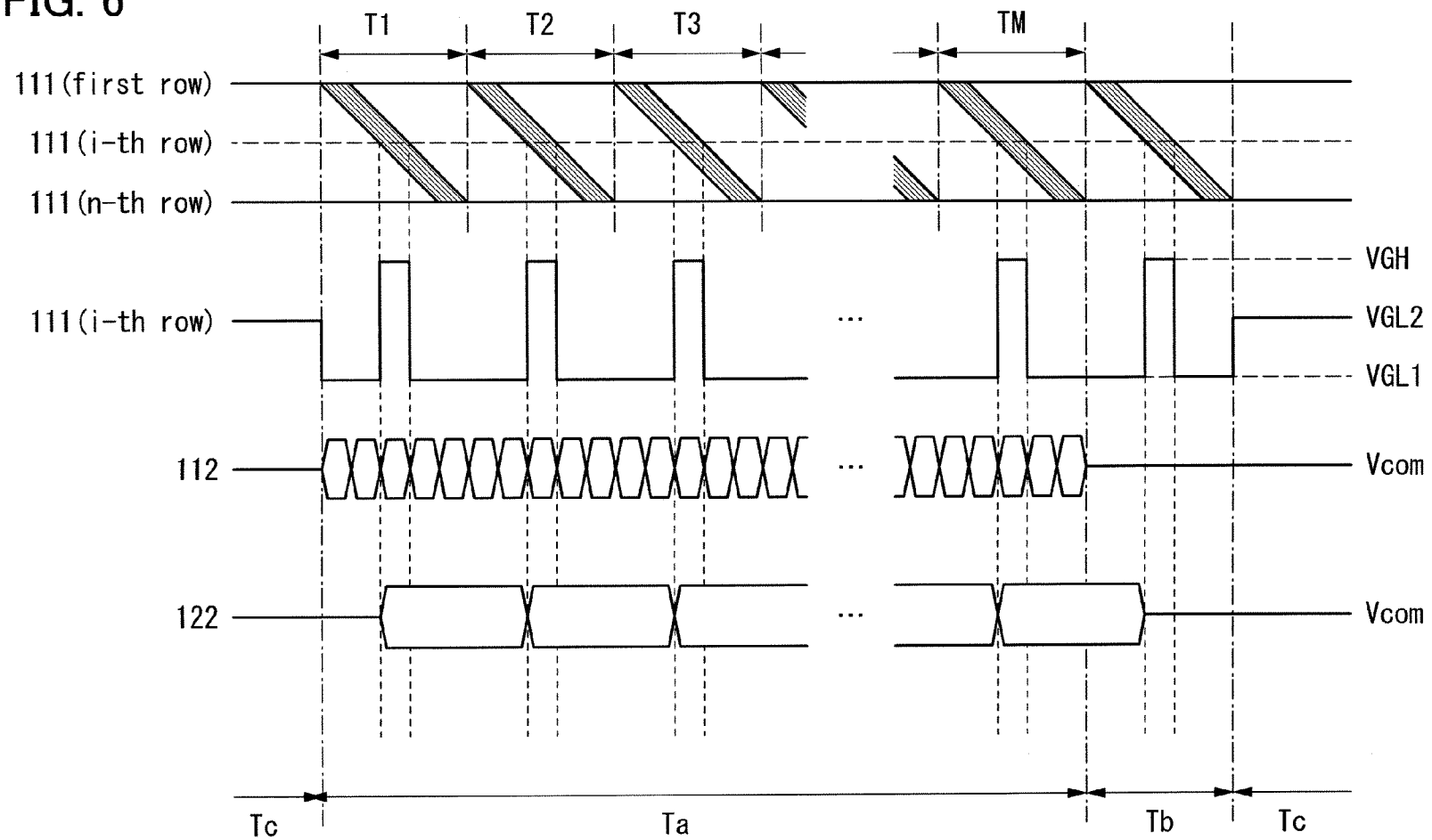
FIG. 6 is a chart for explaining a display device according to one embodiment of the present invention.

Further, in the period Ta, the scan line driver circuit 11 may select the first to n-th rows on a per row basis twice or more. FIG. 6 illustrates a timing chart when the scan line driver circuit 11 scans the first to n-th rows M times (M is a natural number). In the timing chart in FIG. 6, the period Ta is divided into a plurality of sub-periods T (sub-periods T1 to TM). In each of the sub-periods T, the scan line driver circuit 11 sequentially selects the first to n-th rows on a per row basis.

Next, the method for driving the display device in Embodiment 1, illustrated in FIG. 6, will be described in detail. For convenience, a video signal is assumed to have three potentials: a potential higher than the potential of the common electrode 121 (referred to as a potential VH), a potential that is the same or substantially the same as the potential of the common electrode 121, and a potential lower than the potential of the common electrode 121 (referred to as a potential VL). That is, the signal line driver circuit 12 selectively applies one of the three potentials (VH, VL, and Vcom) to each of the m source signal lines 112. Note that for convenience, when a positive voltage is applied to the display element 102, the gray level of the display element 102 is assumed to be closer to black (also referred to as a first gray level). On the other hand, when a negative voltage is applied to the display element 102, the gray level of the display element 102 is assumed to be closer to white (also referred to as a second gray level).

The gray level of the display element 102 is controlled by controlling the potential of the pixel electrode 122 in each of the plurality of sub-periods Tin the period Ta to control a voltage applied to the display element 102. For example, when a video signal with the potential VH is input to the pixel 100, the potential difference between the pixel electrode 122 and the common electrode 121 becomes VH-Vcom, and a positive voltage (also referred to as a first voltage) is applied to the display element 102. When a video signal with the potential VL is input to the pixel 100, the potential difference between the pixel electrode 122 and the common electrode 121 becomes VL-Vcom, and a negative voltage (also referred to as a second voltage) is applied to the display element 102. Moreover, when a signal with the potential Vcom is input to the pixel 100, the pixel electrode 122 and the common electrode 121 have the same potential, and 0 [V] (also referred to as a third voltage) is applied to the display element 102. In the above manner, by inputting a video signal to the pixel 100 and controlling a voltage applied to the display element 102 in each of the plurality of sub-periods T, the positive voltage (VH-Vcom), the negative voltage (VL-Vcom), and 0 [V] can be applied to the display element 102 in various orders. Furthermore, it is possible to control the time for applying the positive voltage, the time for applying the negative voltage, and the time for applying 0 [V] to the display element 102. Thus, the gray level of the display element 102 can be minutely controlled with fewer kinds of video signals.

In the timing chart in FIG. 6, the number of sub-periods T in which a video signal with the potential VH is input to the pixel 100 is larger as the gray level of the display element 102 is closer to the first gray level. That is, the time for applying the positive voltage to the display element 102 is longer in the period Ta as the gray level of the display element 102 is closer to the first gray level. Therefore, in the case where there are a first display element and a second display element and the gray level of the first display element is closer to the first gray level than that of the second display element is, the number of sub-periods T in which a video signal with the potential VH is input is larger for a first pixel including the first display element than for a second pixel including the second display element. In other words, the time for applying the positive voltage to the display element 102 in the period Ta is longer for the first pixel including the first display element than for the second pixel including the second display element.

In the timing chart in FIG. 6, the number of sub-periods T in which a video signal with the potential VL is input to the pixel 100 is larger as the gray level of the display element 102 is closer to the second gray level. That is, the time for applying the negative voltage to the display element 102 is longer in the period Ta as the gray level of the display element 102 is closer to the second gray level. Therefore, in the case where the gray level of the first display element is closer to the second gray level than that of the second display element is, the number of sub-periods Tin which a video signal with the potential VL is input is larger for the first pixel including the first display element than for the second pixel including the second display element. In other words, the time for applying the negative voltage to the display element 102 in the period Ta is longer for the first pixel including the first display element than for the second pixel including the second display element.

In the timing chart in FIG. 6, a number obtained by subtracting the number of sub-periods T in which a video signal with the potential VL is input to the pixel 100 from the number of sub-periods T in which a video signal with the potential VH is input is larger as the gray level of the display element 102 is closer to the first gray level. That is, a time obtained by subtracting the time for applying the negative voltage to the display element 102 from the time for applying the positive voltage is longer in the period Ta as the gray level of the display element 102 is closer to the first gray level. Therefore, in the case where the gray level of the first display element is closer to the first gray level than that of the second display element is, a number obtained by subtracting the number of sub-periods T in which a video signal with the potential VL is input from the number of sub-periods T in which a video signal with the potential VH is input is larger for the first pixel including the first display element than for the second pixel including the second display element. In other words, in the period Ta, a time obtained by subtracting the time for applying the negative voltage to the display element 102 from the time for applying the positive voltage is longer for the first pixel including the first display element than for the second pixel including the second display element.

In the timing chart in FIG. 6, a number obtained by subtracting the number of sub-periods T in which a video signal with the potential VH is input to the pixel 100 from the number of sub-periods T in which a video signal with the potential VL is input is larger as the gray level of the display element 102 is closer to the second gray level. That is, a time obtained by subtracting the time for applying the positive voltage to the display element 102 from the time for applying the negative voltage is longer in the period Ta as the gray level of the display element 102 is closer to the second gray level. Therefore, in the case where the gray level of the first display element is closer to the second gray level than that of the second display element is, a number obtained by subtracting the number of sub-periods T in which a video signal with the potential VH is input from the number of sub-periods T in which a video signal with the potential VL is input is larger for the first pixel including the first display element than for the second pixel including the second display element. In other words, in the period Ta, a time obtained by subtracting the time for applying the positive voltage to the display element 102 from the time for applying the negative voltage is longer for the first pixel including the first display element than for the second pixel including the second display element.

In the timing chart in FIG. 6, a combination of potentials (the potential VH, the potential VL, and the potential Vcom) of video signals input to the pixel 100 may depend on a gray level that the display element 102 has already expressed, in addition to a next gray level that the display element 102 is to express. Therefore, in the case where gray levels that the display element 102 has already expressed are different although next gray levels that the display element 102 is to express are the same, a combination of video signals input to the pixel 100 in each of the plurality of sub-periods T sometimes varies in the period Ta. This results from the fact that the display element 102 has memory properties. Specifically, even when the next gray level that the display element 102 is to express is the same, in the period Ta for expressing the next gray level that the display element 102 is to express, the time for applying the negative voltage to the display element 102 is preferably longer as the time for applying the positive voltage to the display element 102 is longer or a time obtained by subtracting the time for applying the negative voltage to the display element 102 from the time for applying the positive voltage is longer in the period Ta for expressing the gray level that the display element 102 has already expressed, as the number of sub-periods T in which a video signal with the potential VH is input to the pixel 100 is larger in the plurality of sub-periods T, or as a number obtained by subtracting the number of sub-periods T in which a video signal with the potential VL is input to the pixel 100 from the number of sub-periods T in which a video signal with the potential VH is input is larger in the plurality of sub-periods T. Alternatively, the number of sub-periods T in which a video signal with the potential VL is input to the pixel 100 is preferably larger in the plurality of sub-periods T. In such a manner, afterimages can be reduced.

When the plurality of sub-periods T are made to have the same or substantially the same length in the timing chart in FIG. 6, the configuration of the signal line driver circuit can be simplified. Note that the lengths of at least two of the plurality of sub-periods T may be different from each other. In particular, it is preferable that the lengths of the plurality of sub-periods T be weighted. For example, in the case where the number of periods T is four and the length of the first period T is denoted by a time h, the length of the second period T is a time h×2, the length of the third period T is a time h×4, and the length of the fourth period T is a time h×8. When the lengths of the plurality of sub-periods T are weighted in such a manner, the number of times the pixels 100 are selected can be reduced, leading to a reduction in power consumption. Moreover, the time for applying each voltage to the display element 102 can be minutely controlled.

This embodiment can be implemented in combination with any of the other embodiments as appropriate.

Embodiment 2

In Embodiment 2, a scan line driver circuit included in a display device which is one embodiment of the invention disclosed herein will be described.

Figure 7:
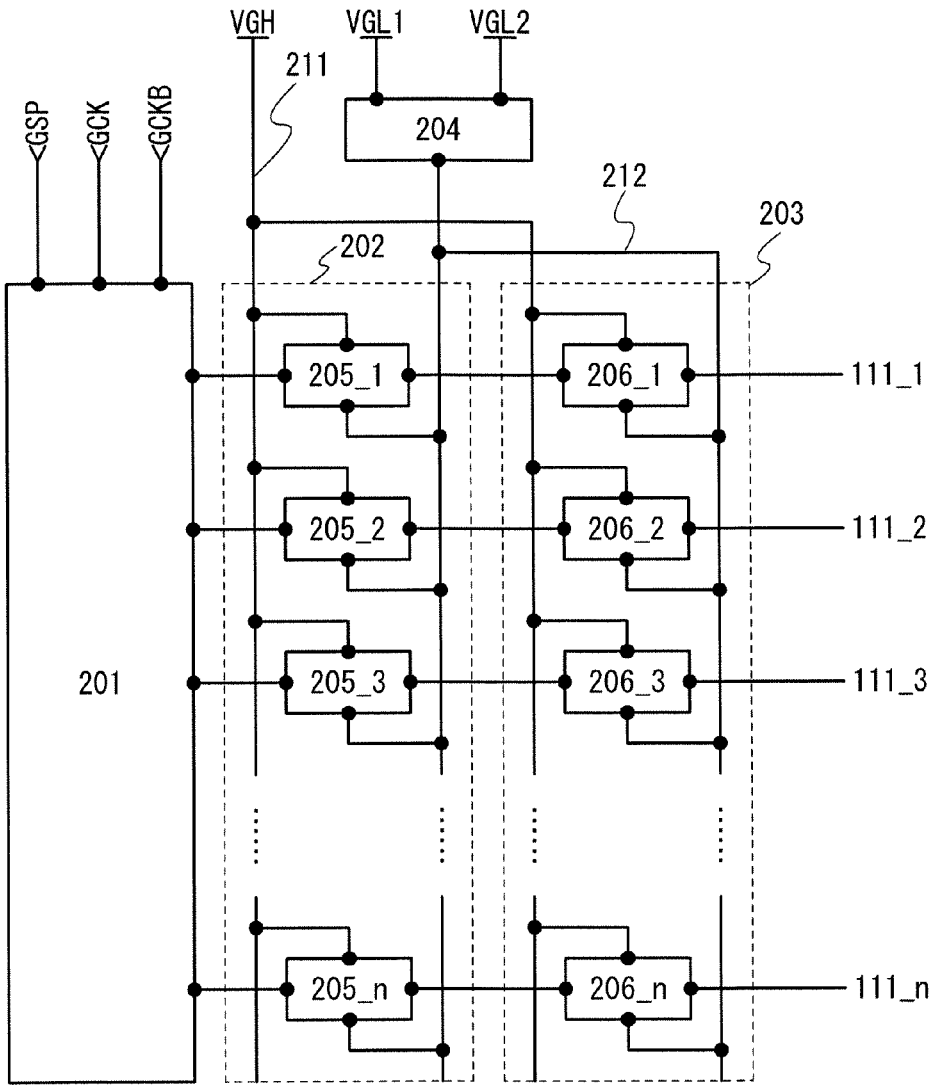
FIG. 7 is a diagram for explaining a display device according to one embodiment of the present invention.

A scan line driver circuit of Embodiment 2 will be described with reference to FIG. 7. The scan line driver circuit in FIG. 7 includes a shift register circuit 201, a level shift unit 202, a buffer unit 203, and a selector circuit 204. The level shift unit 202 includes n level shifter circuits 205 (level shifter circuits 205_1 to **205_*n*). The buffer unit 203 includes n buffer circuits 206 (buffer circuits 206_1 to 206_*n***).

The shift register circuit 201 is supplied with a variety of signals and voltages depending on its configuration and driving method. In FIG. 7, control signals such as a start pulse GSP, a clock signal GCK, and an inverted clock signal GCKB are input to the shift register circuit 201. Note that a power supply voltage supplied to the shift register circuit 201 is omitted here. The shift register circuit 201 generates an output signal for each row (each stage) in accordance with the control signals, and outputs the output signal to the n gate signal lines 111 through the level shift unit 202 and the buffer unit 203 in this order. Note that the output signal of the shift register circuit 201, which is output through the level shift unit 202 and the buffer unit 203, corresponds to a gate signal.

The level shift unit 202 is electrically connected to a wiring (also referred to as a power supply line) 211 and a wiring (also referred to as a power supply line) 212. The level shift unit 202 changes a high-level potential of the output signal of the shift register circuit 201 in accordance with the potential of the wiring 211, and changes a low-level potential thereof in accordance with the potential of the wiring 212. The potential VGH is applied to the wiring 211. The potential VGL1 and the potential VGL2 are selectively applied to the wiring 212 by the selector circuit 204. Note that in the period Ta and the period Tb, the potential VGL1 is applied to the wiring 212. Accordingly, in the period Ta and the period Tb, the level shift unit 202 converts the output signal of the shift register circuit 201 into a signal whose high-level potential is the potential VGH and whose low-level potential is the potential VGL1. Moreover, in the period Tc, the potential VGL2 is applied to the wiring 212. Accordingly, in the period Tc, the level shift unit 202 converts the output signal of the shift register circuit 201 into a signal whose high-level potential is the potential VGH and whose low-level potential is the potential VGL2. The output signal of the shift register circuit 201, whose potentials are changed by the level shift unit 202, is output to the n gate signal lines 111 through the buffer unit 203.

Note that a decoder circuit may be used instead of the shift register circuit 201, in which case rows can be selected in given order or partial driving can be easily realized.

Figure 8A:
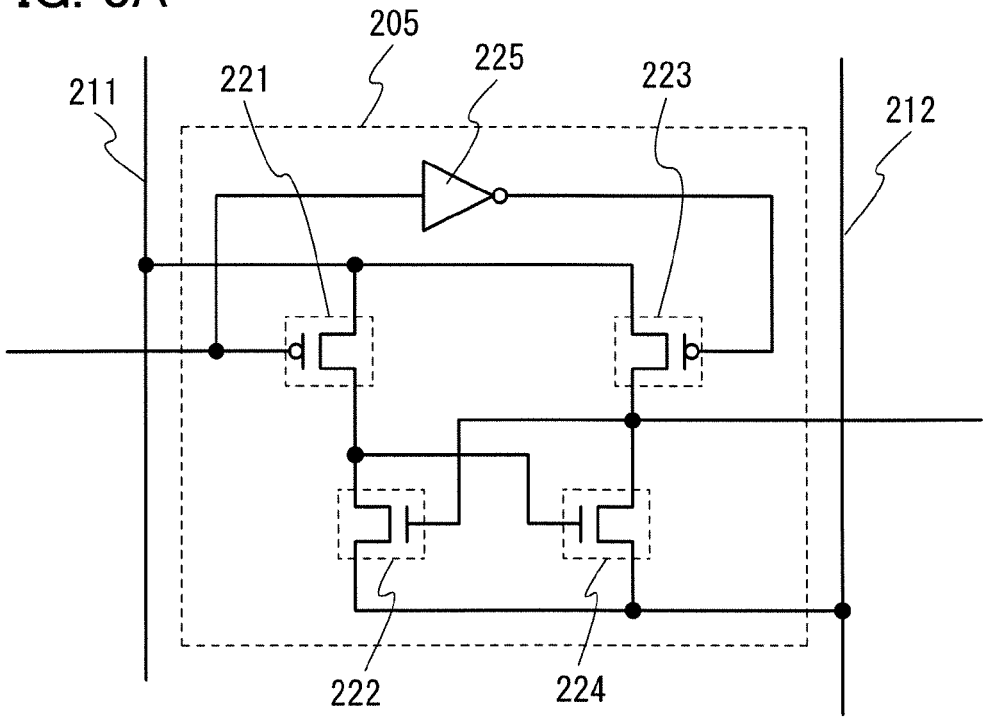
FIGS. 8A and 8B are diagrams for explaining a display device according to one embodiment of the present invention.

Next, the level shifter circuit 205 will be described with reference to FIG. 8A. FIG. 8A illustrates a structural example of the level shifter circuit 205 when the low-level potential of the output signal of the shift register circuit 201 is made the same or substantially the same as the potential applied to the wiring 212 (i.e. . . . , the potential VGL1 or the potential VGL2). The level shifter circuit 205 illustrated in FIG. 8A includes a transistor 221, a transistor 222, a transistor 223, a transistor 224, and an inverter circuit 225. The transistors 221 and 223 are p-channel transistors. The transistors 222 and 224 are n-channel transistors. A first terminal of the transistor 221 is electrically connected to the wiring 211. A second terminal of the transistor 221 is electrically connected to a gate of the transistor 224. A gate of the transistor 221 is electrically connected to a gate of the transistor 223 through the inverter circuit 225. A first terminal of the transistor 222 is electrically connected to the wiring 212. A second terminal of the transistor 222 is electrically connected to the gate of the transistor 224. A first terminal of the transistor 223 is electrically connected to the wiring 211. A second terminal of the transistor 223 is electrically connected to a gate of the transistor 222. A first terminal of the transistor 224 is electrically connected to the wiring 212. A second terminal of the transistor 224 is electrically connected to the gate of the transistor 222. The gate of the transistor 221 may be electrically connected to an output terminal of the shift register circuit 201. The second terminal of the transistor 223 may be electrically connected to an input terminal of the buffer circuit 206.

Figure 8B:
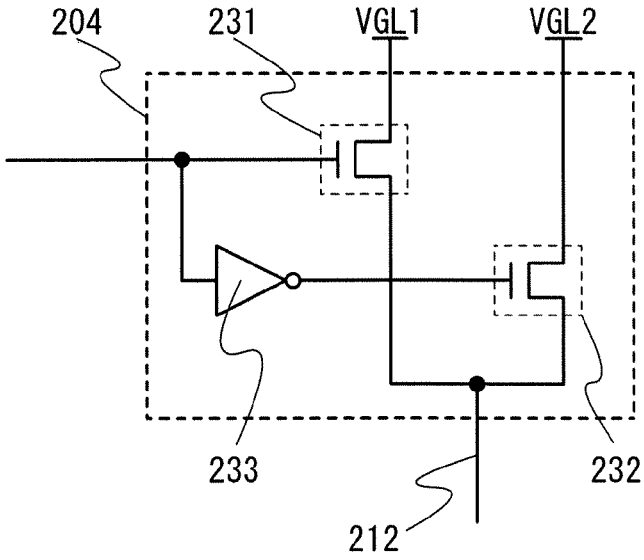

Next, the selector circuit 204 will be described with reference to FIG. 8B. The selector circuit 204 illustrated in FIG. 8B includes a transistor 231, a transistor 232, and an inverter circuit 233. A first terminal of the transistor 231 is electrically connected to a wiring supplied with the potential VGL1. A second terminal of the transistor 231 is electrically connected to the wiring 212. A gate of the transistor 231 is electrically connected to a gate of the transistor 232 through the inverter circuit 233. A first terminal of the transistor 232 is electrically connected to a wiring supplied with the potential VGL2. A second terminal of the transistor 232 is electrically connected to the wiring 212. The wiring electrically connected to the first terminal of the transistor 231 is supplied with a control signal having a function of selecting whether the potential VGL1 or the potential VGL2 is applied to the wiring 212. The control signal is a digital signal and inverted at the timing at which the period Tb is switched to the period Tc and the timing at which the period Tc is switched to the period Ta. The transistor 231 is a switch having a function of controlling electrical continuity between the wiring supplied with the potential VGL1 and the wiring 212. The transistor 232 is a switch having a function of controlling electrical continuity between the wiring supplied with the potential VGL2 and the wiring 212. For those reasons, CMOS switches may be used as the transistors 231 and 232. Moreover, bipolar transistors are preferably used as the transistors 231 and 232 because a large current sometimes flows through the wiring 212. In addition, the transistors 231 and 232 are preferably n-channel transistors or PNP transistors because the first terminal of the transistor 231 is supplied with the potential VGL1 and the first terminal of the transistor 232 is supplied with the potential VGL2.

The scan line driver circuit in Embodiment 2 can select whether the low-level potential of the gate signal is the potential VGL1 or the potential VGL2, by selecting the potential applied to the wiring 212. Therefore, when the scan line driver circuit in Embodiment 2 is used in the display device which is one embodiment of the invention disclosed herein, the driving method described in Embodiment 1 can be realized without complication of the circuit.

This embodiment can be implemented in combination with any of the other embodiments as appropriate.

Embodiment 3

In Embodiment 3, an example of a transistor included in a display device which is one embodiment of the invention disclosed herein will be described. There is no particular limitation on the structure of the transistor included in the display device which is one embodiment of the invention disclosed herein. For example, it is possible to use a staggered transistor or a planar transistor having a top-gate structure in which a gate electrode is placed on an upper side of a semiconductor layer with a gate insulating layer placed therebetween or a bottom-gate structure in which a gate electrode is placed on a lower side of a semiconductor layer with a gate insulating layer placed therebetween. Further, the transistor may have a single-gate structure including one channel formation region, a double-gate structure including two channel formation regions, or a triple-gate structure including three channel formation regions. Alternatively, the transistor may have a dual-gate structure including two gate electrode layers placed over and below a channel region with a gate insulating layer provided therebetween. FIGS. 9A to 9D each illustrate an example of a cross-sectional structure of a transistor.

Note that in the transistors illustrated in FIGS. 9A to 9D, an oxide semiconductor is used for a semiconductor layer. Advantages of using an oxide semiconductor are that a high field-effect mobility (a maximum value of 5 $cm^2$/Vsec or more, preferably a maximum value in the range of 10 $cm^2$/Vsec to 150 $cm^2$/Vsec) can be obtained when the transistor is on, and a low off-state current per unit channel width (e.g., less than 1 aA/μm, preferably less than 10 zA/μm and less than 100 zA/μm at 85° C. per unit channel width) can be obtained when the transistor is off.

Figure 9A:
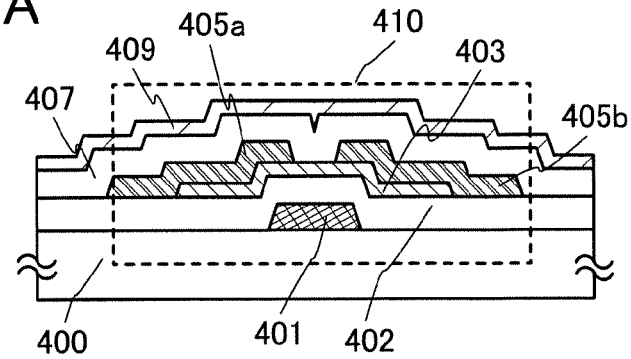
FIGS. 9A to 9D are diagrams each explaining a display device according to one embodiment of the present invention.

A transistor 410 illustrated in FIG. 9A is one of bottom-gate transistors and is also referred to as an inverted staggered transistor.

The transistor 410 includes, over a substrate 400 having an insulating surface, a gate electrode layer 401, a gate insulating layer 402, an oxide semiconductor layer 403, a source electrode layer 405*a*, and a drain electrode layer 405*b*. Moreover, an insulating film 407 that covers the transistor 410 and is stacked over the oxide semiconductor layer 403 is provided. A protective insulating layer 409 is formed over the insulating film 407.

Figure 9B:
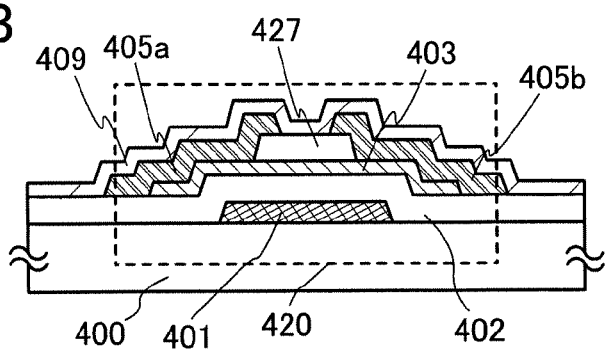

A transistor 420 illustrated in FIG. 9B has a kind of bottom-gate structure called a channel-protective structure (a channel-stop structure) and is also referred to as an inverted staggered transistor.

The transistor 420 includes, over a substrate 400 having an insulating surface, a gate electrode layer 401, a gate insulating layer 402, an oxide semiconductor layer 403, an insulating layer 427 that functions as a channel protective layer covering a channel formation region of the oxide semiconductor layer 403, a source electrode layer 405*a*, and a drain electrode layer 405*b*. A protective insulating layer 409 is formed so as to cover the transistor 420.

Figure 9C:
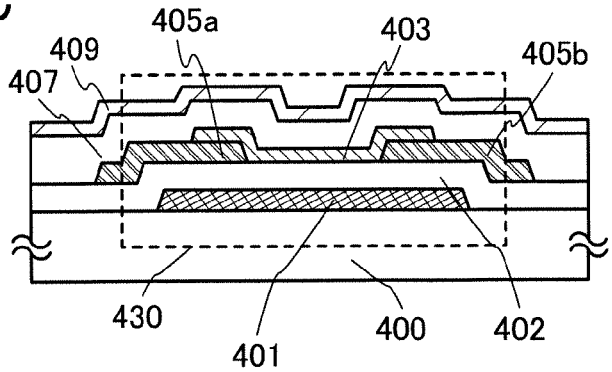

A transistor 430 illustrated in FIG. 9C is a bottom-gate transistor and includes, over a substrate 400 having an insulating surface, a gate electrode layer 401, a gate insulating layer 402, a source electrode layer 405*a*, a drain electrode layer 405*b*, and an oxide semiconductor layer 403. An insulating film 407 that covers the transistor 430 and is in contact with the oxide semiconductor layer 403 is provided. A protective insulating layer 409 is formed over the insulating film 407.

In the transistor 430, the gate insulating layer 402 is provided on and in contact with the substrate 400 and the gate electrode layer 401, and the source electrode layer 405*a* and the drain electrode layer 405*b* are provided on and in contact with the gate insulating layer 402. Furthermore, the oxide semiconductor layer 403 is provided over the gate insulating layer 402, the source electrode layer 405*a*, and the drain electrode layer 405*b*.

Figure 9D:
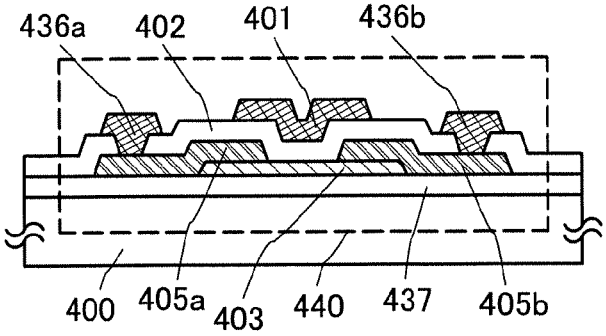

A transistor 440 illustrated in FIG. 9D is one of top-gate transistors. The transistor 440 includes, over a substrate 400 having an insulating surface, an insulating layer 437, an oxide semiconductor layer 403, a source electrode layer 405*a*, a drain electrode layer 405*b*, a gate insulating layer 402, and a gate electrode layer 401. A wiring layer 436*a* and a wiring layer 436*b* are provided in contact with the source electrode layer 405*a* and the drain electrode layer 405*b*, respectively.

In this embodiment, the oxide semiconductor layer 403 is used as a semiconductor layer as described above. An oxide semiconductor used for the oxide semiconductor layer 403 contains at least one element selected from In, Ga, Sn, and Zn. Examples of applicable oxide semiconductors are an oxide of four metal elements, such as an In—Sn—Ga—Zn—O-based oxide semiconductor; an oxide of three metal elements, such as an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor layer, and a Sn—Al—Zn—O-based oxide semiconductor; an oxide of two metal elements, such as an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, an In—Mg—O-based oxide semiconductor, and an In—Ga—O-based material; and an oxide of one metal element, such as an In—O-based oxide semiconductor, a Sn—O-based oxide semiconductor, and a Zn—O-based oxide semiconductor. In addition, any of the above oxide semiconductors may contain an element other than In, Ga, Sn, and Zn, for example, $SiO_2$.

For example, an In—Ga—Zn—O-based oxide semiconductor means an oxide semiconductor containing indium (In), gallium (Ga), and zinc (Zn), and there is no limitation on the composition ratio thereof.

Further, for the oxide semiconductor layer, a thin film expressed by a chemical formula of $InMO_3(ZnO)_m$ (m>0) can be used. Here, M represents one or more metal elements selected from Zn, Ga, Al, Mn, and Co. For example, M can be Ga, Ga and Al, Ga and Mn, or Ga and Co.

In the case where an In—Zn—O-based material is used as an oxide semiconductor, a target used has a composition ratio of In:Zn=50:1 to 1:2 in an atomic ratio ($In_2O_3$: ZnO=25:1 to 1:4 in a molar ratio), preferably In:Zn=20:1 to 1:1 in an atomic ratio ($In_2O_3$: ZnO=10:1 to 1:2 in a molar ratio), further preferably In:Zn=15:1 to 1.5:1 in an atomic ratio ($In_2O_3$: ZnO=15:2 to 3:4 in a molar ratio). For example, in a target used for forming an In—Zn—O-based oxide semiconductor that has an atomic ratio of In:Zn:O=X:Y:Z, the relation of Z>1.5X+Y is satisfied.

In the transistors 410, 420, 430, and 440 each including the oxide semiconductor layer 403, the current in an off state (off-state current) can be low. Thus, a capacitor for holding an electric signal such as a video signal can be designed to be smaller in a pixel. As a result, the aperture ratio of the pixel can be increased, and power consumption can be reduced accordingly.

In addition, because of low off-state current of the transistors 410, 420, 430, and 440 including the oxide semiconductor layer 403, the pixel can hold an electric signal such as a video signal for a longer period of time, and moreover, the interval between write operations can be set longer. Accordingly, the cycle of one frame period can be set longer, and the frequency of refresh operations in a still image display period can be reduced; thus, an effect of suppressing power consumption can be further enhanced. Furthermore, the above transistors can be formed in both a driver circuit portion and a pixel portion over one substrate, so that the number of components of the display device can be reduced.

Although there is no particular limitation on a substrate that can be used as the substrate 400 having an insulating surface, a glass substrate made of barium borosilicate glass, aluminoborosilicate glass, or the like is used.

In the bottom-gate structure transistors 410, 420, and 430, an insulating film serving as a base film may be provided between the substrate and the gate electrode layer. The base film has a function of preventing diffusion of an impurity element from the substrate, and can be formed with a single-layer structure or a stacked structure using one or more of a silicon nitride film, a silicon oxide film, a silicon nitride oxide film, and a silicon oxynitride film.

The gate electrode layer 401 can be formed with a single-layer structure or a stacked structure using a metal material such as molybdenum, titanium, chromium, tantalum, tungsten, aluminum, copper, neodymium, or scandium or an alloy material containing any of these materials as its main component.

The gate insulating layer 402 can be formed with a single-layer structure or a stacked structure using any of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer by plasma CVD, sputtering, or the like. For example, a silicon nitride layer ($SiN_y$ (y>0)) with a thickness of 50 nm to 200 nm is formed by plasma CVD as a first gate insulating layer, and a silicon oxide layer ($SiO_x$ (x>0)) with a thickness of 5 nm a to 300 nm is stacked over the first gate insulating layer as a second gate insulating layer, so that a gate insulating layer with a total thickness of 200 nm is formed.

As a conductive film used for the source electrode layer 405*a* and the drain electrode layer 405*b*, a metal film containing an element selected from Al, Cr, Cu, Ta, Ti, Mo, and W or a metal nitride film containing any of the above elements as its main component (e.g., a titanium nitride film, a molybdenum nitride film, or a tungsten nitride film) can be used, for example. Moreover, a refractory metal film of Ti, Mo, W, or the like or a metal nitride film of any of these elements (e.g., a titanium nitride film, a molybdenum nitride film, or a tungsten nitride film) may be stacked on one or both of the lower side and the upper side of a metal film of Al, Cu, or the like.

The conductive film used as the wiring layer 436*a* and the wiring layer 436*b*, which are connected to the source electrode layer 405*a* and the drain electrode layer 405*b* respectively, can be formed using a material similar to that for the source electrode layer 405*a* and the drain electrode layer 405*b*.

Alternatively, the conductive film to be the source electrode layer 405*a* and the drain electrode layer 405*b* (including a wiring layer formed using the same layer as the source and drain electrode layers) may be formed using a conductive metal oxide. As the conductive metal oxide, indium oxide ($In_2O_3$), tin oxide ($SnO_2$), zinc oxide (ZnO), an alloy of indium oxide and tin oxide ($In_2O_3$—$SnO_2$, referred to as ITO), an alloy of indium oxide and zinc oxide ($In_2O_3$—ZnO), or such a metal oxide material containing silicon oxide can be used.

As the insulating films 407 and 427 that are placed over the oxide semiconductor layer and the insulating layer 437 that is placed below the oxide semiconductor layer, an inorganic insulating film such as a silicon oxide film, a silicon oxynitride film, an aluminum oxide film, or an aluminum oxynitride film can be typically used.

As the protective insulating layer 409 provided over the oxide semiconductor layer, an inorganic insulating film such as a silicon nitride film, an aluminum nitride film, a silicon nitride oxide film, or an aluminum nitride oxide film can be used.

In addition, a planarization insulating film may be formed over the protective insulating layer 409 in order to reduce surface roughness due to the transistor. For the planarization insulating film, an organic material such as polyimide, acrylic, or benzocyclobutene can be used. Other than such organic materials, it is also possible to use a low-dielectric constant material (a low-k material) or the like. Note that the planarization insulating film may be formed by stacking a plurality of insulating films formed from these materials.

As described above, the off-state current of the transistor including the oxide semiconductor layer formed according to Embodiment 3 can be low. Therefore, the pixel can hold an electric signal such as a video signal for a longer period of time, and moreover, the interval between write operations can be set longer. Accordingly, the cycle of one frame period can be set longer, and the frequency of refresh operations in a still image display period can be reduced; thus, an effect of suppressing power consumption can be further enhanced. The oxide semiconductor layer is preferable in that it can be formed without a process such as laser irradiation and allows a transistor to be formed over a large substrate.

This embodiment can be implemented in appropriate combination with the structures described in the other embodiments.

Embodiment 4

In Embodiment 4, a structure of a display device, which is one embodiment of the invention disclosed herein, having a touch-panel function will be described with reference to FIGS. 10A and 10B.

Figure 10A:
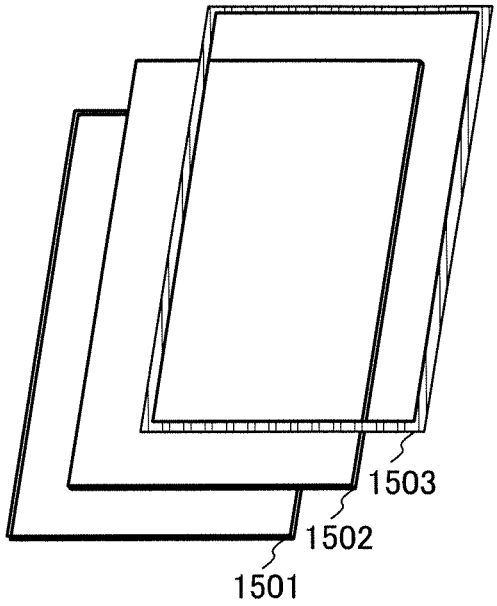
FIGS. 10A and 10B each illustrate a display device according to one embodiment of the present invention.

FIG. 10A is a schematic diagram of a display device in Embodiment 4. FIG. 10A illustrates a structure where a touch panel unit 1502 overlaps a display panel 1501 which is the display device according to the above embodiment and they are attached together in a housing (a case) 1503. For the touch panel unit 1502, a resistive touchscreen, a surface capacitive touchscreen, a projected capacitive touchscreen, or the like can be used as appropriate.

As illustrated in FIG. 10A, the display panel 1501 and the touch panel unit 1502 are separately fabricated and overlap with each other, so that costs for manufacturing the display device having a touch panel function can be reduced.

Figure 10B:
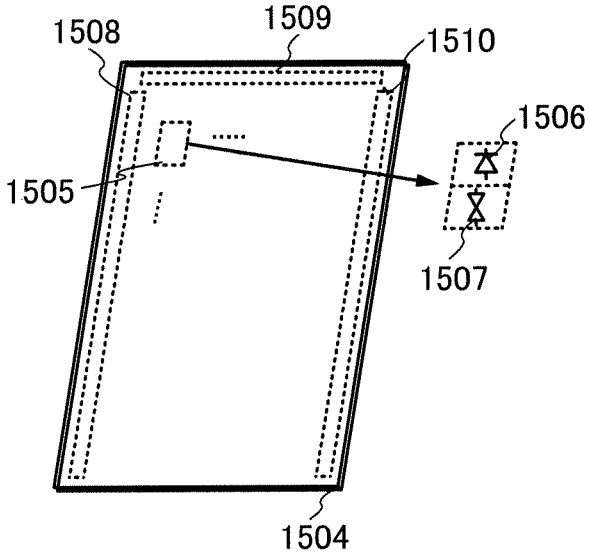

FIG. 10B illustrates a structure of a display device having a touch panel function, which is different from that illustrated in FIG. 10A. A display device 1504 illustrated in FIG. 10B includes a plurality of pixels 1505 each including an optical sensor 1506 and a display element 1507 (e.g., an electrophoretic element or a liquid crystal element). Therefore, unlike in FIG. 10A, the touch panel unit 1502 is not necessarily stacked, so that the display device can be reduced in thickness. When a gate line driver circuit 1508, a signal line driver circuit 1509, and an optical sensor driver circuit 1510 are formed over a substrate where the pixels 1505 are provided, the display device can be reduced in size. Note that the optical sensor 1506 may be formed using amorphous silicon or the like and overlap with a transistor including an oxide semiconductor.

According to this embodiment, a transistor including an oxide semiconductor film is used in a display device having a touch panel function, so that image retention at the time of displaying a still image can be improved. Moreover, it is possible to reduce deterioration of image quality due to change in gray level when a still image is displayed with a reduced refresh rate.

This embodiment can be implemented in combination with any of the other embodiments as appropriate.

Embodiment 5

In this embodiment, an example of an electronic device including the display device described in any of the above embodiments will be described.

Figure 11A:
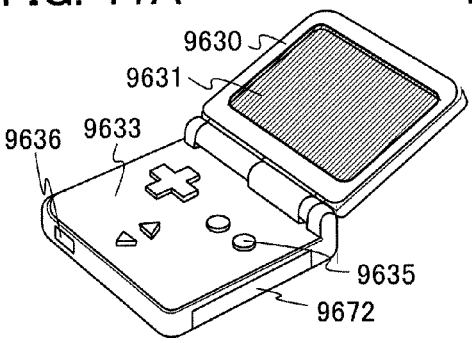
FIGS. 11A to 11D each illustrate an electronic device according to one embodiment of the present invention.

FIG. 11A illustrates a portable game machine that includes a housing 9630, a display portion 9631, a speaker 9633, operation keys 9635, a connection terminal 9636, a memory medium reading portion 9672, and the like. The portable game machine in FIG. 11A has a function of reading a program or data stored in a memory medium to display it on the display portion, a function of sharing information with another portable game machine by wireless communication, and the like. Note that the portable game machine in FIG. 11A has a variety of functions without limitation to the above.

Figure 11B:
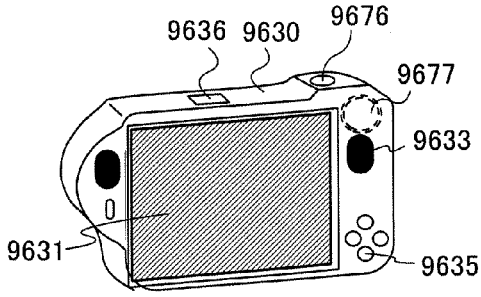

FIG. 11B illustrates a digital camera that includes a housing 9630, a display portion 9631, a speaker 9633, operation keys 9635, a connection terminal 9636, a shutter button 9676, an image receiving portion 9677, and the like. The digital camera in FIG. 11B has a function of photographing a still image and/or a moving image, a function of automatically or manually correcting the photographed image, a function of obtaining various kinds of information from an antenna, a function of saving the photographed image or the information obtained from the antenna, a function of displaying the photographed image or the information obtained from the antenna on the display portion, and the like. Note that the digital camera in FIG. 11B has a variety of functions without limitation to the above.

Figure 11C:
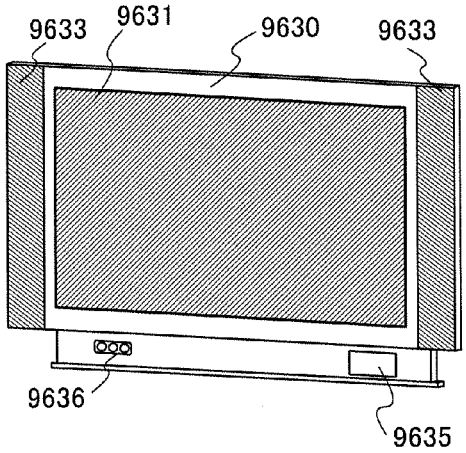

FIG. 11C illustrates a television set that includes a housing 9630, a display portion 9631, speakers 9633, operation key 9635, a connection terminal 9636, and the like. The television set in FIG. 11C has a function of converting an electric wave for television into an image signal, a function of converting an image signal into a signal suitable for display, a function of converting the frame frequency of an image signal, and the like. Note that the television set in FIG. 11C has a variety of functions without limitation to the above.

Figure 11D:
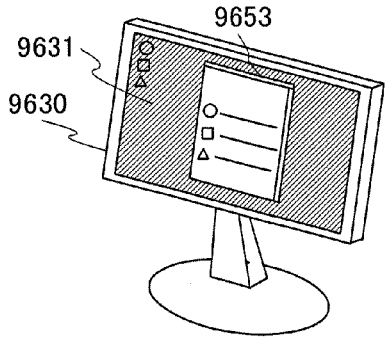

FIG. 11D illustrates a monitor for electronic computers (personal computers) (i.e., a PC monitor), and the monitor includes a housing 9630, a display portion 9631, and the like. As an example, in the monitor in FIG. 11D, a window 9653 is displayed on the display portion 9631. Note that FIG. 11D illustrates the window 9653 displayed on the display portion 9631 for explanation; a symbol such as an icon or an image may be displayed. In the monitor for a personal computer, an image signal is rewritten only at the time of inputting in many cases, which is preferable when the method for driving a display device in the above embodiment is applied. Note that the monitor in FIG. 11D has a variety of functions without limitation to the above.

Figure 12A:
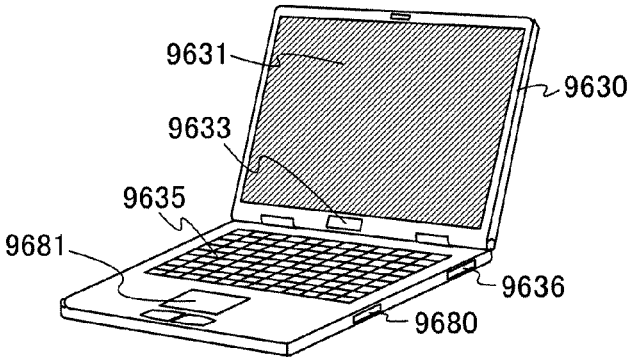
FIGS. 12A to 12D each illustrate an electronic device according to one embodiment of the present invention.

FIG. 12A illustrates a computer that includes a housing 9630, a display portion 9631, a speaker 9633, operation keys 9635, a connection terminal 9636, a pointing device 9681, an external connection port 9680, and the like. The computer in FIG. 12A has a function of displaying a variety of information (e.g., a still image, a moving image, and a text image) on the display portion, a function of controlling processing by a variety of software (programs), a communication function such as wireless communication or wired communication, a function of being connected to various computer networks with the communication function, a function of transmitting and/or receiving a variety of data with the communication function, and the like. Note that the computer in FIG. 12A has a variety of functions without limitation to the above.

Figure 12B:
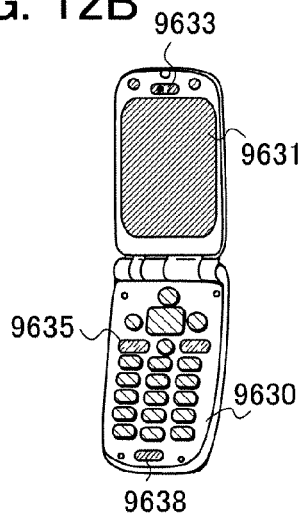

FIG. 12B illustrates a mobile phone that includes a housing 9630, a display portion 9631, a speaker 9633, operation keys 9635, a microphone 9638, and the like. The mobile phone in FIG. 12B has a function of displaying a variety of information (e.g., a still image, a moving image, and a text image) on the display portion; a function of displaying a calendar, a date, the time, or the like on the display portion; a function of operating and/or editing the information displayed on the display portion; a function of controlling processing by various kinds of software (programs); and the like. Note that the mobile phone in FIG. 12B has a variety of functions without limitation to the above.

Figure 12C:
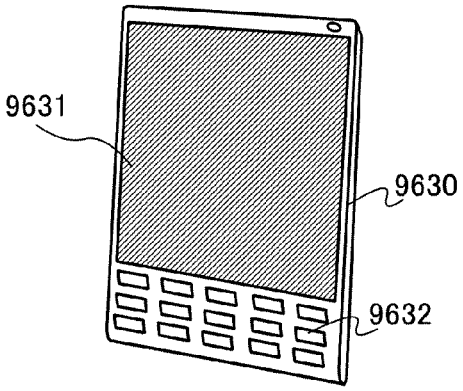
Figure 12D:
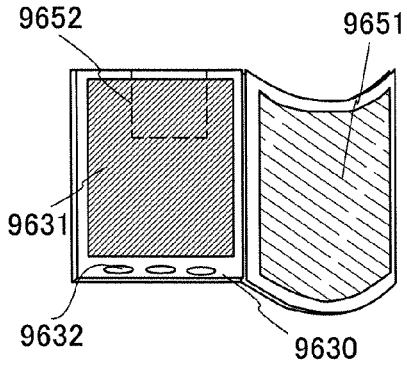

FIG. 12C illustrates an electronic device including electronic paper (also referred to as an eBook or an e-book reader) that includes a housing 9630, a display portion 9631, operation keys 9632, and the like. The e-book reader in FIG. 12C has a function of displaying a variety of information (e.g., a still image, a moving image, and a text image) on the display portion; a function of displaying a calendar, a date, the time, and the like on the display portion; a function of operating and/or editing the information displayed on the display portion; a function of controlling processing by various kinds of software (programs); and the like. Note that the e-book reader in FIG. 12C has a variety of functions without being limited to the above functions. FIG. 12D illustrates another structure of an e-book reader. The e-book reader in FIG. 12D has a structure obtained by adding a solar battery 9651 and a battery 9652 to the e-book reader in FIG. 12C. When a reflective display device is used as the display portion 9631, the e-book reader is expected to be used in a comparatively bright environment, in which case the structure in FIG. 12D is preferable because the solar battery 9651 can efficiently generate power and the battery 9652 can efficiently charge power. Note that when a lithium ion battery is used as the battery 9652, an advantage such as reduction in size can be obtained.

Since the electronic device described in Embodiment 5 includes the display device in Embodiment 1, the display quality can be improved.

This embodiment can be implemented in appropriate combination with the structures described in the other embodiments.

This application is based on Japanese Patent Application serial No. 2010-116046 filed with Japan Patent Office on May 20, 2010, the entire contents of which are hereby incorporated by reference.

What is claimed is:

1. A method for driving a display device, comprising the steps of:

providing a display element between a pixel electrode and a common electrode and a transistor comprising a first terminal electrically connected to a source signal line, a second terminal electrically connected to the pixel electrode, and a gate electrically connected to a gate signal line;

in a first period, applying a first potential to the gate signal line to turn on the transistor, inputting a first signal to the pixel electrode through the source signal line to produce an image on a display portion while the transistor is turned on, and applying a second potential to the gate signal line to turn off the transistor;

in a second period, applying a third potential to the gate signal line to turn on the transistor, inputting a second signal to the pixel electrode through the source signal line to maintain the image on the display portion while the transistor is turned on, and applying a fourth potential to the gate signal line to turn off the transistor; and applying a fifth potential to the gate signal line to turn off the transistor after the second period while maintaining the image on the display portion, wherein an absolute value of a potential difference between the fifth potential and a potential of the second signal is smaller than an absolute value of a potential difference between the fourth potential and the potential of the second signal.

2. The method for driving a display device, according to claim 1, wherein the first signal has a sixth potential higher than a potential of the common electrode, a seventh potential lower than the potential of the common electrode, and a eighth potential lower than the sixth potential and higher than the seventh potential.

3. The method for driving a display device, according to claim 1, wherein the second signal is a signal for maintaining a gray level of the display element.

4. The method for driving a display device, according to claim 1, wherein a channel formation region of the transistor comprises an oxide semiconductor.

5. A method for driving a display device, comprising the steps of:

providing a display element between a pixel electrode and a common electrode and a transistor comprising a first terminal electrically connected to a source signal line, a second terminal electrically connected to the pixel electrode, and a gate electrically connected to a gate signal line;

in a first period, applying a first potential to the gate signal line to turn on the transistor, inputting a first signal to the pixel electrode through the source signal line to produce an image on a display portion while the transistor is turned on, and applying a second potential to the gate signal line to turn off the transistor;

in a second period, applying a third potential to the gate signal line to turn on the transistor, inputting a second signal to the pixel electrode through the source signal line to maintain the image on the display portion while the transistor is turned on, and applying a fourth potential to the gate signal line to turn off the transistor; and applying a fifth potential to the gate signal line to turn off the transistor after the second period while maintaining the image on the display portion, wherein the fifth potential is higher than the fourth potential and lower than the first potential.

6. The method for driving a display device, according to claim 5, wherein the first signal has a sixth potential higher than a potential of the common electrode, a seventh potential lower than the potential of the common electrode, and a eighth potential lower than the sixth potential and higher than the seventh potential.

7. The method for driving a display device, according to claim 5, wherein the second signal is a signal for maintaining a gray level of the display element.

8. The method for driving a display device, according to claim 5, wherein a channel formation region of the transistor comprises an oxide semiconductor.

9. A display device comprising:

a pixel including a display element between a pixel electrode and a common electrode and a transistor comprising a first terminal electrically connected to a source signal line, a second terminal electrically connected to the pixel electrode, and a gate electrically connected to a gate signal line;

a gate driver circuit configured to selectively apply a first potential and a second potential to the gate signal line in a first period, apply a third potential and a fourth potential to the gate signal line in a second period, and apply a fifth potential to the gate signal line after the second period; and a source driver circuit configured to output a first signal to the source signal line to produce an image on a display portion in the first period while the transistor is turned on and output a second signal to the source signal line to maintain the image on the display portion in the second period while the transistor is turned on, wherein each of the first potential and the third potential is a potential for turning on the transistor, wherein each of the second potential and the fourth potential is a potential for turning off the transistor, wherein the third potential is a potential for turning off the transistor, and wherein an absolute value of a potential difference between the fifth potential and a potential of the second signal is smaller than an absolute value of a potential difference between the fourth potential and the potential of the second signal.

10. The display device according to claim 9, wherein the first signal has a sixth potential higher than a potential of the common electrode, a seventh potential lower than the potential of the common electrode, and a eighth potential lower than the sixth potential and higher than the seventh potential.

11. The display device according to claim 9, wherein the second signal is a signal for maintaining a gray level of the display element.

12. The display device according to claim 9, wherein a channel formation region of the transistor comprises an oxide semiconductor.

13. A display device comprising:

a pixel including a display element between a pixel electrode and a common electrode and a transistor comprising a first terminal electrically connected to a source signal line, a second terminal electrically connected to the pixel electrode, and a gate electrically connected to a gate signal line;

a gate driver circuit configured to selectively apply a first potential and a second potential to the gate signal line in a first period, apply a third potential and a fourth potential to the gate signal line in a second period, and apply a fifth potential to the gate signal line after the second period; and a source driver circuit configured to output a first signal to the source signal line to produce an image on a display portion in the first period while the transistor is turned on and output a second signal to the source signal line to maintain the image on the display portion in the second period while the transistor is turned on, wherein each of the first potential and the third potential is a potential for turning on the transistor, wherein each of the second potential and the fourth potential is a potential for turning off the transistor, and wherein the fifth potential is a potential for turning off the transistor, and is higher than the fourth potential and lower than the first potential.

14. The display device according to claim 13, wherein the first signal has a sixth potential higher than a potential of the common electrode, a seventh potential lower than the potential of the common electrode, and a eighth potential lower than the sixth potential and higher than the seventh potential.

15. The display device according to claim 13, wherein the second signal is a signal for maintaining a gray level of the display element.

16. The display device according to claim 13, wherein a channel formation region of the transistor comprises an oxide semiconductor.

* * * * *